US006739783B2

(12) United States Patent
Higashino et al.

(10) Patent No.: US 6,739,783 B2
(45) Date of Patent: May 25, 2004

(54) BINDER

(75) Inventors: Takayoshi Higashino, Osaka (JP); Seiichi Koike, Osaka (JP); Kenichi Izumi, Aichi-ken (JP)

(73) Assignee: Kokuyo Co., Ltd., Osaka (JP)

( * ) Notice: Subject to any disclaimer, the term of this patent is extended or adjusted under 35 U.S.C. 154(b) by 0 days.

(21) Appl. No.: 09/884,144

(22) Filed: Jun. 20, 2001

(65) Prior Publication Data

US 2002/0009326 A1 Jan. 24, 2002

(30) Foreign Application Priority Data

| | | |
|---|---|---|
| Jul. 4, 2000 | (JP) | 2000-206838 |
| Dec. 19, 2000 | (JP) | 2000-385682 |
| Mar. 16, 2001 | (JP) | 2001-076370 |

(51) Int. Cl.[7] ..... B42F 3/00; B42F 13/12; B42F 13/36

(52) U.S. Cl. ..... 402/60; 24/67 R; 24/67.11; 24/67.5; 24/67.7; 24/506; 24/517; D18/34; D19/86; D19/88

(58) Field of Search ..... 402/60; 24/67 R, 24/67.11, 67.5, 67.7, 506, 517; D18/34; D19/86, 88

(56) References Cited

U.S. PATENT DOCUMENTS

| | | | | | |
|---|---|---|---|---|---|
| 938,621 | A | * | 11/1909 | Wagoner | 24/67.7 |
| 2,879,773 | A | * | 3/1959 | Miyakawa | 402/25 |
| 3,492,701 | A | * | 2/1970 | Kitamura | 227/90 |
| 3,706,502 | A | * | 12/1972 | La Fleur | 402/17 |
| 3,827,109 | A | * | 8/1974 | Langwell | 24/67.5 |
| 3,891,093 | A | * | 6/1975 | Petrie | 211/46 |
| 4,453,743 | A | * | 6/1984 | Sanders et al. | 281/18 |
| D293,886 | S | * | 1/1988 | Chang | D8/395 |
| 4,903,379 | A | * | 2/1990 | Uchtman | 24/351 |
| 5,410,783 | A | * | 5/1995 | Stoelinga | 24/511 |
| 5,479,682 | A | * | 1/1996 | Hendrikx et al. | 24/67 R |
| 5,546,638 | A | * | 8/1996 | Chiodaroli | 24/67.9 |
| 5,570,907 | A | * | 11/1996 | Dromi et al. | 281/45 |
| D376,813 | S | * | 12/1996 | Haug et al. | D18/34 |
| 5,658,014 | A | * | 8/1997 | Barker et al. | 281/45 |

FOREIGN PATENT DOCUMENTS

| | | | |
|---|---|---|---|
| CH | 221945 | * | 6/1942 |
| EP | 1172232 | * | 1/2002 |
| GB | 27532 | | 3/1910 |

* cited by examiner

*Primary Examiner*—A. L. Wellington
*Assistant Examiner*—Mark Henderson
(74) *Attorney, Agent, or Firm*—Lowe Hauptman Gilman & Berner LLP

(57) ABSTRACT

A binder comprises an operating member supported on a base, a pressing member movable toward and away from the base by the movement of the operating member, and locking means for locking the operating member when the pressing member is set in a binding position. The operating member has a first operating spot and a second operating spot, and the operating member is locked to hold the pressing member at the binding position when the first operating spot is pressed toward the surface of the base, and unlocked to move the pressing member away from the base when the second operating spot is operated similarly.

10 Claims, 37 Drawing Sheets

BINDER

BACKGROUND OF THE INVENTION

1. Field of the Invention

The present invention relates to a binder, and more particularly to a binder capable of releasing, by an extremely simple operation, an operating member from a locked state when a pressing member is set in a binding position.

2. Related Art

As a conventional binder, for example, a type as shown in FIG. 55 is known. In this binder 200, a metal member is formed as a forming material. The binder 200 comprises a base 202 fixed inside of a cover sheet 201, a pressing member 204 supported on this base 202 through a plurality of coupling shafts 203, and an operating member 206 coupled to the pressing member 204 through a coil spring 205.

The base 202 is composed of a setting plane 210 contacting with the inside of the cover sheet 201, a support wall 211 standing upward from one end of this setting plane 210, and a plurality of intermediate walls 212 formed by raising part of the setting plane 210 and disposed substantially parallel to the support wall 211. The support wall 211 has a plurality of round holes 211A. and a square hole 211B for locking the operating member 206.

The pressing member 204 is shaped with a downward C-shaped cross section. Specifically, it comprises a rectangular flat plane 204A and a pair of side planes 204B extending from both longitudinal side edges of the flat plane 204A and having holes 204C in a plurality of locations.

The coil spring 205 is provided around a pin 213 disposed between the support wall 211 and one of the intermediate walls 212. One end side of the coil spring 205 penetrates through the hole 204C located in substantially the center of the pressing member 204, while the other end side is disposed so as to extend to the free end side at the lower side position of the operating member 206. When the operating member 206 is in the prone position illustrated, the pressing member 204 applies a pressing force to paper P, whereas the operating member 206 always applies force in an upward or rising direction.

The coupling shaft 203 is in crank shaped, with one end side penetrating and extending through the holes 204C located in both sides in the longitudinal direction of the pressing member 204, and the other end side disposed between the support wall 211 and intermediate wall 212. Accordingly, when the pressing member 204 moves closer to or away from the setting plane 210 of the base 202, it is able to move while remaining parallel with the setting plane 210.

One end side of the operating member 206 is supported on the pin 213, penetrating through the coil portion of the coil spring 205. In the side portion of the free end side of the operating member 206, toward the front or nearer side in the drawing, a protrusion 214 corresponding to the location where a square hole 211B is provided, and this protrusion 214 is hooked in the square hole 211B so that the operating member 206 is maintained in a locked position.

In this binder 200, however, when unlocking the operating member 206, while pressing the free end side of the operating member 206 to the setting plane 210 side, a force must be also applied in a horizontal direction away from the support wall 211 (horizontal direction to the right side in FIG. 55), thus requiring operation in two directions, thereby complicating the simple operation. In particular, if a large number of sheets are bound, the spring force of the coil spring 205 is strong such that applying operating force in two directions results in the pressing force being distributed, and it may be difficult to unlock. Such operation causes torsion in the operating member 206 so that the load on the base side is heavy, causing and the operating member 206 to deform or malfunction.

SUMMARY OF THE INVENTION

The present invention is devised in light of such inconvenience, and it is hence an object thereof to provide a binder capable of locking and unlocking an operating member by applying force to the operating member in one direction only.

It is another object of the invention to provide a binder capable of locking and unlocking the operating member only by displacing a part of locking means.

To achieve these objects, the invention provides a binder comprising an operating member having one end supported on a base and the other end provided movably as a free end, a pressing member movable selectively toward and away from the base by the movement of the operating member, a spring member disposed between the pressing member and the operating member, and locking means for locking the operating member when the pressing member is set in a binding position, in which, when being selectively locked and unlocked, the operating member can be selectively locked and unlocked without changing the direction of the operating force during operation so that the convenience of operation is obtained.

Further, when being selectively locked and unlocked, the operating member can be selectively locked and unlocked without changing the direction of the operating force applied against the bias force of the spring member during operation, or the operating member can be locked and unlocked without changing the rotational trajectory of the operating member.

Moreover, the operating member of the invention has first and second operating spots(area, region or portion), in which the operating member is locked and the pressing member is held in the binding position when the first operating spot is operated in a specified direction, and the locking is released to move the pressing member away from the base when the second operating spot is operated in the specified direction. Such a configuration is convenient because the locking can be released by only operating the second operating spot in the same direction as the operating direction applied to the first operating spot. That is, unlike the related art, it is not necessary to apply pressing force and horizontal force simultaneously to the operating member. This enables operating force to be securely applied to the operating member. It relieves distortion from torsion and the like in the operating member.

The first and second operating spots in the invention can be divided by forming a slit in the operating member. As a result, the operating member may be formed in an extremely simple structure.

The operating member may be also composed by assembling a separate part for forming the second operating spot in the main body having the first operating spot. At this time, the separate part may be made of a piece member housed within the main body, with this piece member preferred to be provided movable in the unlocking direction but held so as not to fall out. In such a configuration, the operating force applied to the first and second operating spots is completely independent so that the accuracy of operation can be enhanced.

Further, the locking means comprises an extended shaft portion extending to the spring member and extending to the first and second operating spots, and a hook portion provided in the base selectively hooking the extended shaft portion, in which, when the first operating spot is pressed, the extended shaft portion engages on the hook portion so as to lock, and when the second operating spot is pressed, the axial position of the extended shaft portion is displaced to so as to release the lock. At this time, in the second operating spot, preferably, a contact member contacting a part of the extended shaft portion is provided so that the extended shaft portion can be displaced in the unlocking direction with the displacement of the contact member when the second operating spot is pressed. In such a configuration, a locking mechanism making use of an existing spring member may be employed, and deformation of the operating member can be reliably prevented as the extended shaft portion displaces the axial position by operation of the second operating spot.

The operating member may also have a guide portion for keeping the trajectory of displacement of the extended shaft portion constant. In such a configuration, stable displacement of the extended shaft portion is maintained such that a malfunction can be prevented.

In other aspect of the present invention, a binder comprises an operating member having one end supported on a base and the other end provided movably as a free end, a pressing member movable selectively toward and away from the base by movement of the operating member, a spring member disposed between the pressing member and the operating member, and locking means for locking the operating member when the pressing member is set in a binding position, in which the locking means comprises a first lock forming portion provided in the operating member, and a second lock forming portion provided at the base side to be hooked onto the first lock forming portion, and the locking of the operating member can be released by displacing the first lock forming portion or the second lock forming portion from the hooking position. In such a configuration, by applying an external force, for example, from a fingertip, to the second lock forming member, hooking of each lock forming portion can be released and the binding force to the pressing means can be released by the force of the spring member.

The first lock forming portion is a hole provided in the operating member, and the second lock forming portion comprises a standing member inserted in the hole and hooked onto the edge of the hole. Therefore, the binding position of the operating member is able to be locked by only moving the operating member to the binding position.

Alternatively, the first lock forming portion may comprise an outer edge of the operating member and the second lock forming portion may comprise a standing member to be selectively hooked onto the outer edge. In such a configuration, the lock means can be composed in a structure which obviates the need for a hole in the operating member so as to simplify the structure of the operating member.

Preferably, the tip of the standing member is provided so as to project from the upper side of the operating member when the operating member is in the binding position. As a result, the force for displacing the standing member may be easily applied to the standing member. Moreover, by maintaining the height or length of the standing member, the standing member can be displaced easily and locking can be released without requiring excessive force. It is also easy to set the operating member in the binding position.

The first lock forming member may be formed of a slide member movable within a range of the operating member in the extending direction of the operating member, and by movement of the slide member, hooking onto the second lock forming member can be released. In such a configuration, the hooking of each lock forming portion can be released smoothly.

Moreover, locking can be released by operating the first lock forming portion in the extending direction of the operating member. This enables an operating force can be applied easily to the first lock forming portion.

DESCRIPTION OF THE PREFERRED EMBODIMENTS

Figure 1:
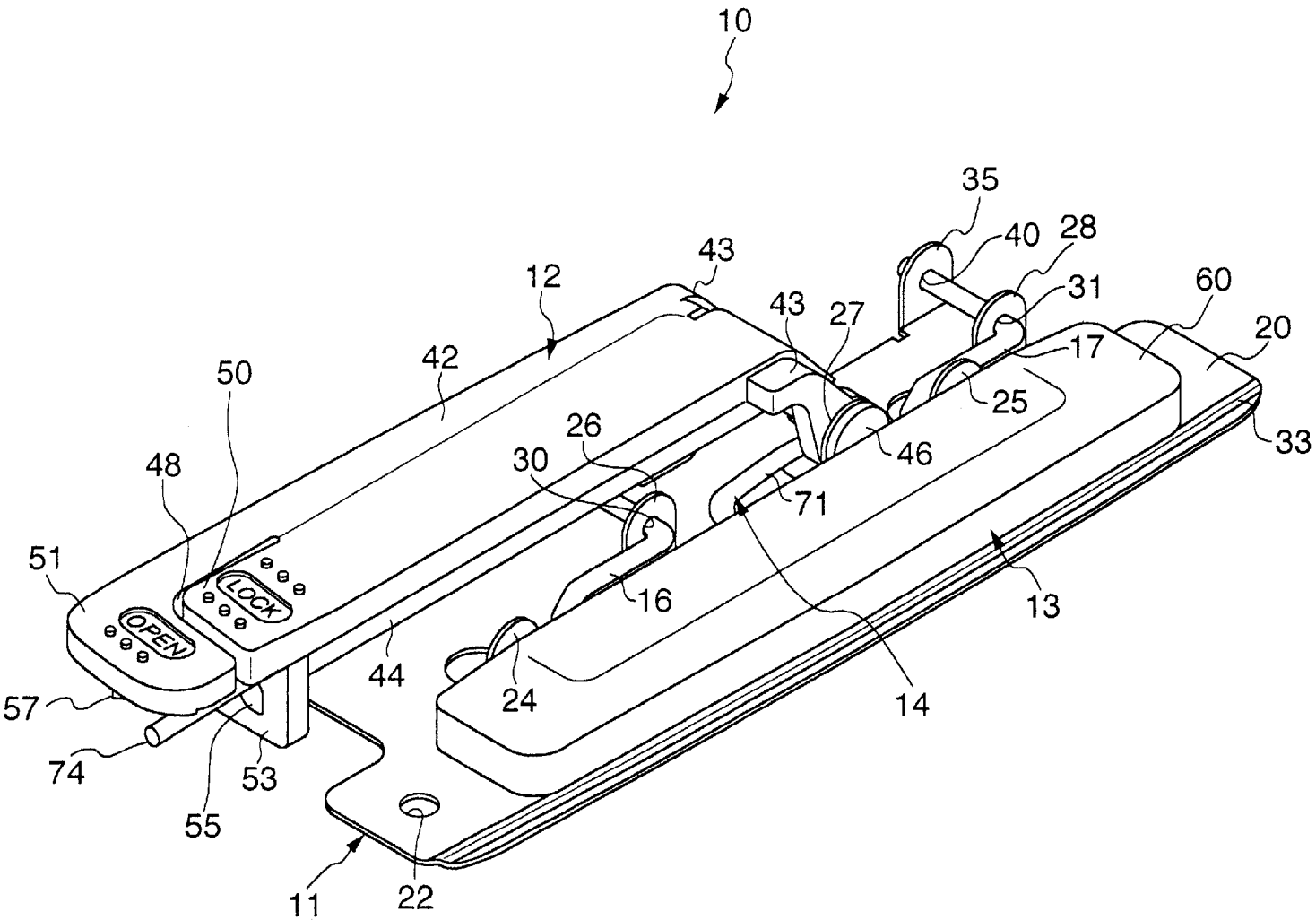
FIG. 1 is a schematic perspective view showing an entire structure of a binder according to a first embodiment of the present invention.

Referring now to the drawings, the preferred embodiments will hereinafter be described below.

First Embodiment

Figure 2:
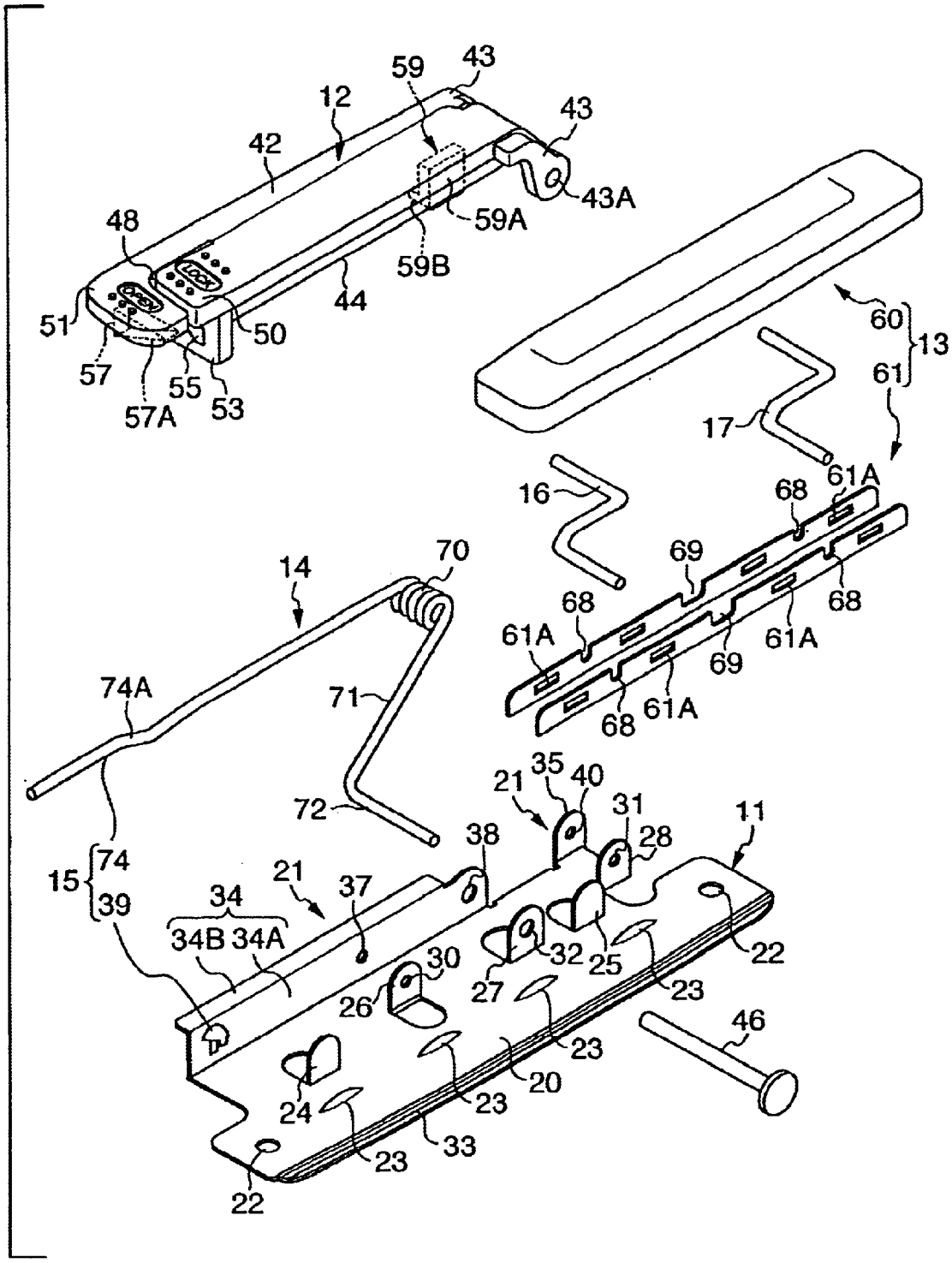
FIG. 2 is an exploded perspective view of FIG. 1
Figure 3:
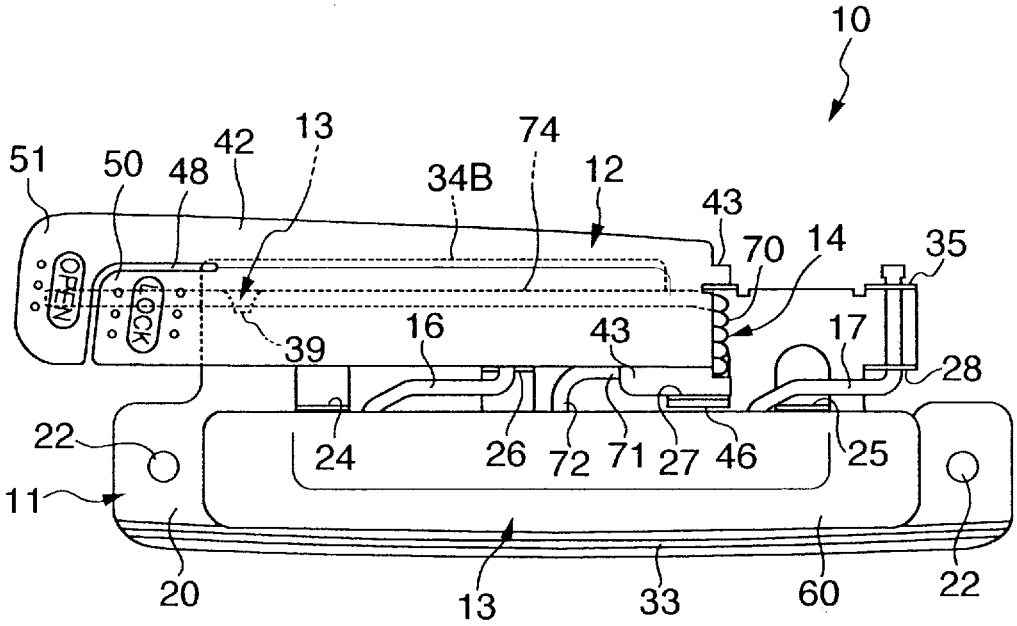
FIG. 3 is a plan view of FIG. 1.

FIG. 1 through FIG. 26 show a binder according to a first embodiment of the present invention. In FIG. 1 and FIG. 2 showing the entire structure and exploded perspective view thereof, a binder 10 comprises a base 11, a lever-shaped operating member 12 supported by the base 11, a pressing member 13 movable toward and away from the base 11 by the movement of the operating member 12, a spring member 14 disposed between the pressing member 13 and the operating member 12, locking means 15 for locking the operating member 12 when the pressing member 13 is set in the binding position shown in FIG. 1, and first and second coupling shafts 16 and 17 for supporting the pressing member 13 on the base 11.

Figure 4:
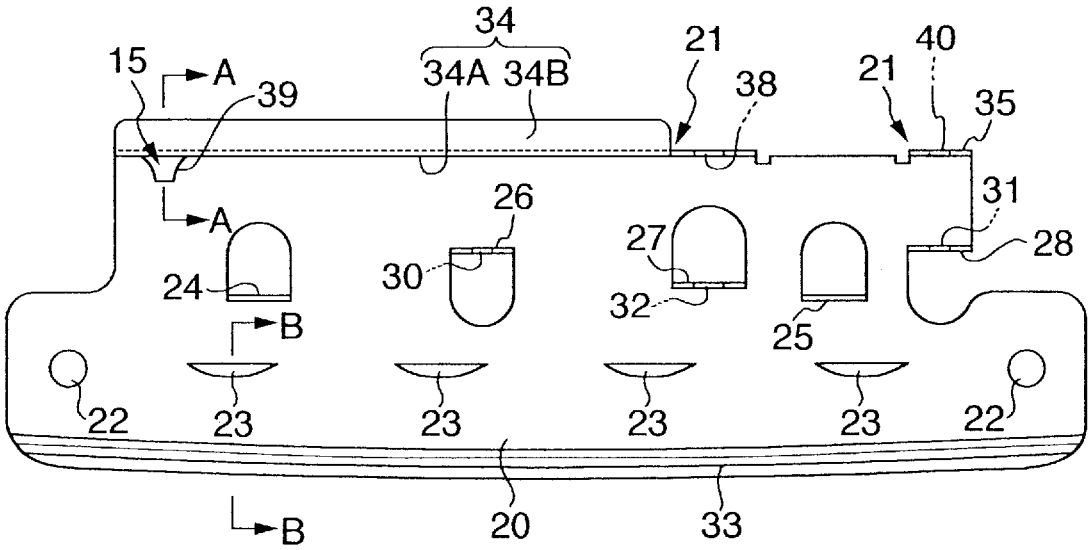
FIG. 4 is a plan view of a base.
Figure 5:
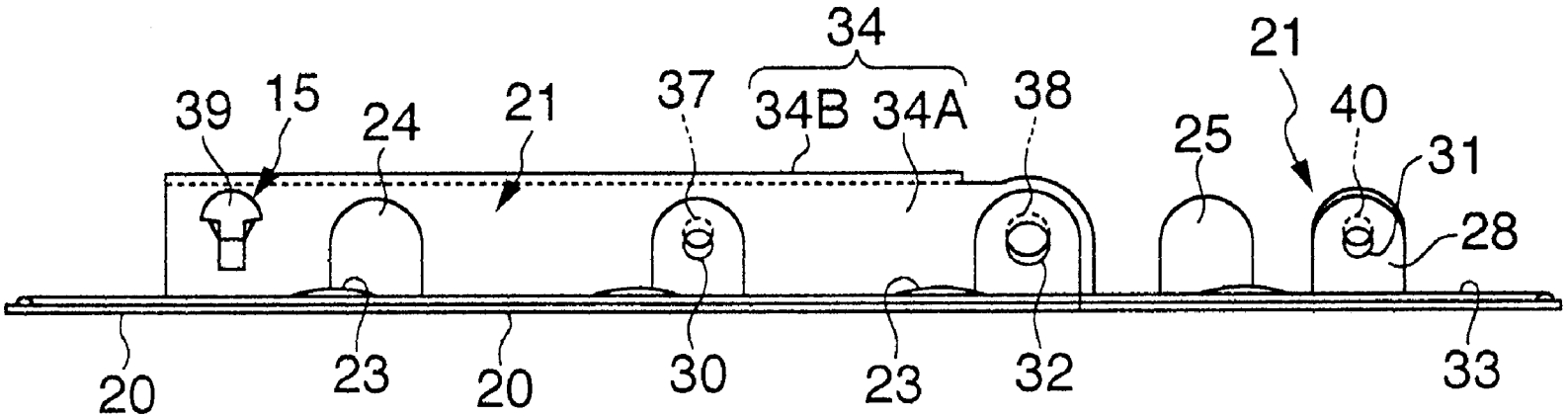
FIG. 5 is a front view of the base.
Figure 6:
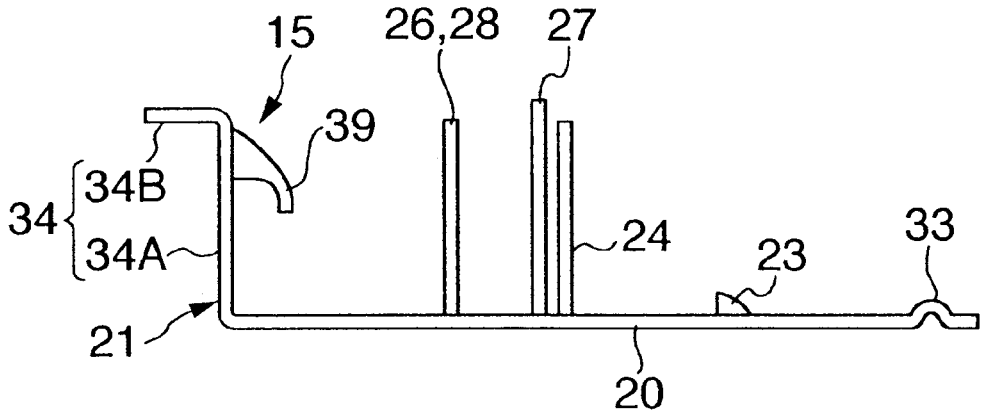
FIG. 6 is an enlarged left side view of FIG. 4.
Figure 7:
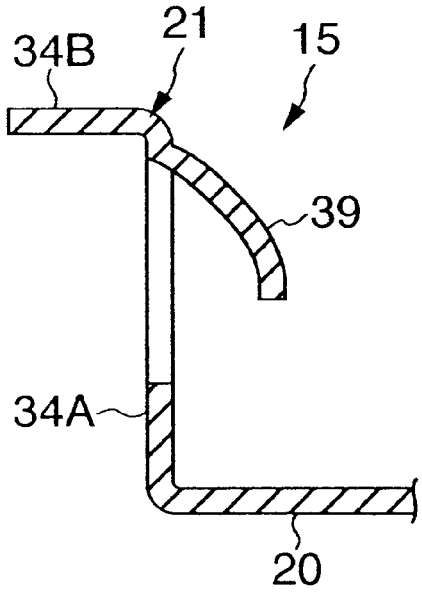
FIG. 7 is an enlarged sectional view taken along line A—A in FIG. 4.
Figure 8:
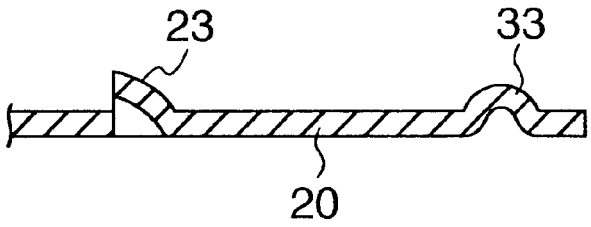
FIG. 8 is an enlarged sectional view taken along line B—B in FIG. 4.
Figure 9:
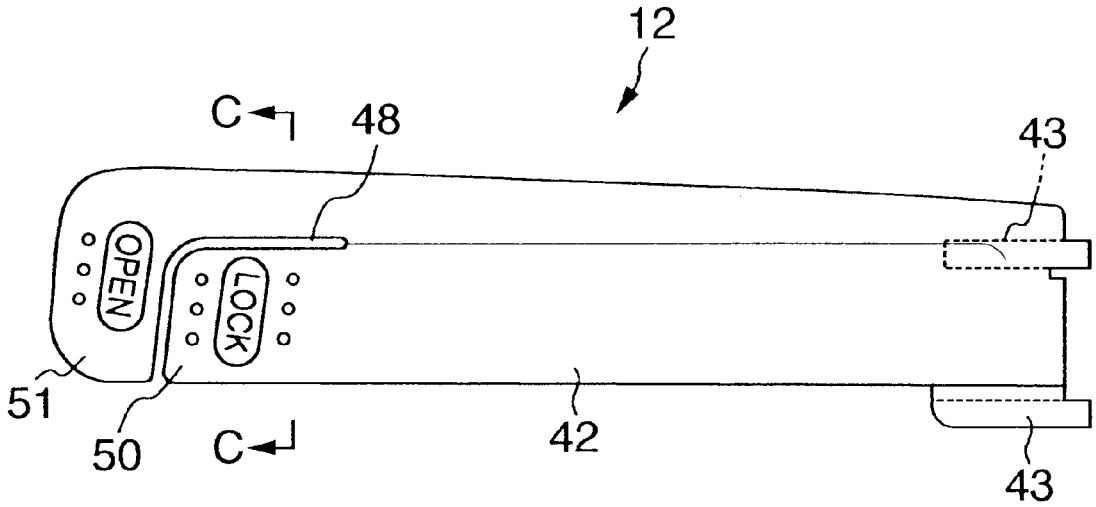
FIG. 9 is a plan view of an operating member.
Figure 10:
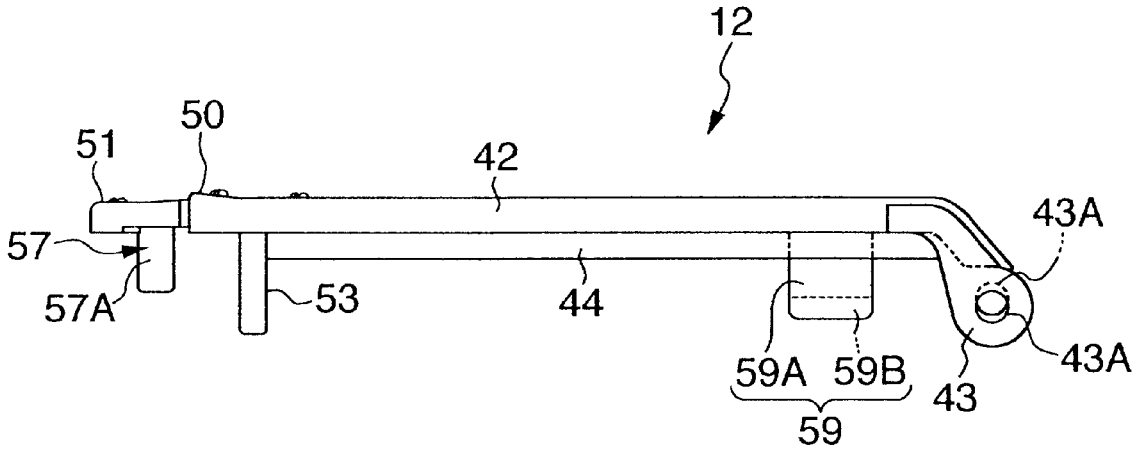
FIG. 10 is a front view of the operating member.
Figure 11:
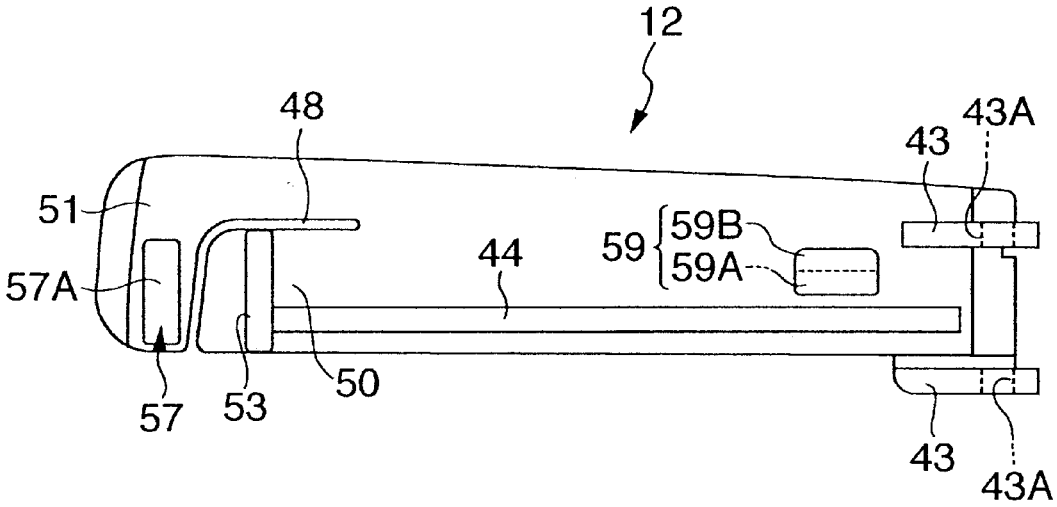
FIG. 11 is a bottom view of the operating member.
Figure 12:
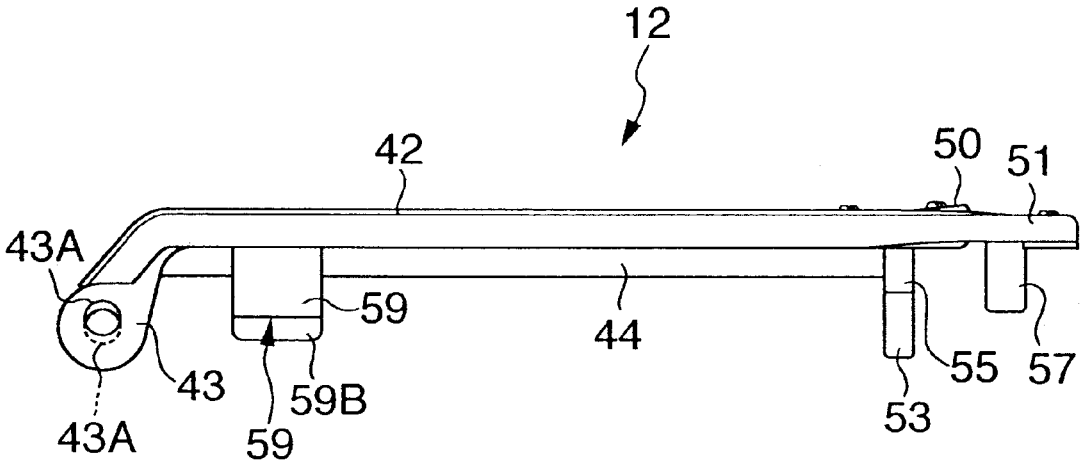
FIG. 12 is a back view of the operating member.
Figure 13:
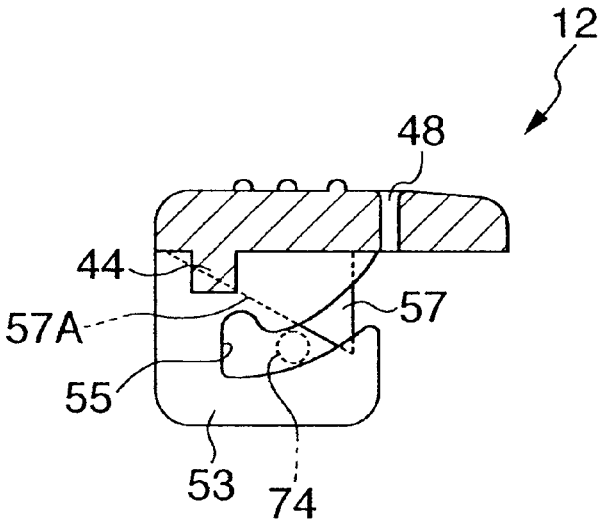
FIG. 13 is an enlarged sectional view taken along line C—C in FIG. 9.
Figure 14:
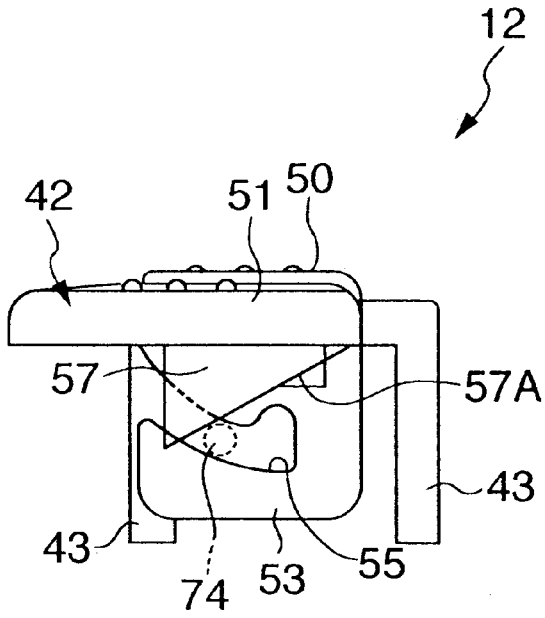
FIG. 14 is an enlarged left side view of FIG. 10.
Figure 15:
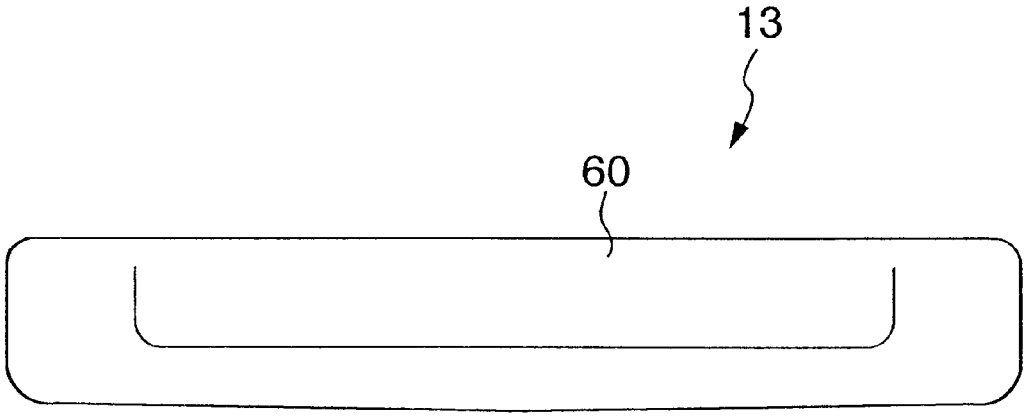
FIG. 15 is a plan view of a plate body for forming a pressing member.

The base 11 is formed of a metal material. The base 11, as shown in FIG. 3 to FIG. 8, comprises a setting plane 20 extending in the vertical direction or lateral direction of a cover sheet, not shown, and a support wall 21 standing upward extending to one end in the longitudinal direction of the setting plane 20. Inside of the setting plane 20, fixing holes 22 are formed in both sides in its longitudinal direction, and by using these fixing holes 22, the base 11 can be fixed to the specified cover sheet by using rivets, not shown. At four positions between the fixing holes 22 and 22, as shown in FIG. 4, crescent raised portions 23 are formed, and fall-out resistance is applied to the documents to be bound by these raised portions 23. Further, in substantially the middle in the longitudinal direction of the setting plane 20, document end butts 24 and 25 are disposed by partially raising the setting plane 20, and between these butts 24 and 25, a first intermediate wall 26 and a bearing wall 27 are disposed, being formed similarly by raising. At one end in the longitudinal direction of the setting plane 20 (at the right end side in FIG. 4), a second intermediate wall 28 is formed at a position substantially flush with the first intermediate wall 26. Inside of the first and second intermediate walls 26 and 28 and bearing wall 27, holes 30, 31, and 32 are formed, respectively. Moreover in the setting plane 20, a rib-like protrusion 33 extending in the longitudinal direction is formed at the opposite side of the position where the support wall 21 is formed.

The support wall 21 comprises a first support wall 34 extending in the longitudinal direction of the setting plane 20, and a second support wall 35 having the same shape as the second intermediate wall 28 at a position facing the second intermediate wall 28. The first support wall 34 is formed of a raised plane 34A, and a bent plane 34B extending to the upper end of the raised plane 34A horizontally toward the outside. Inside of the raised plane 34A, holes 37 and 38 are formed respectively corresponding to the holes 30 and 32 formed in the first intermediate wall 26 and bearing wall 27, and there is a hook portion 39 in a downward key shape forming a part of the locking means 15. In the second support wall 35, a hole 40 is formed corresponding to the hole 31 formed in the second intermediate wall 28.

The operating member 12 is formed of a synthetic resin material. The operating member 12 comprises, as shown in FIG. 10 to FIG. 14, a main body 42 of a flat rectangular plate, a pair of bearing blades 43 and 43 disposed at two positions in the longitudinal direction at one end side of the main body 42, and a rib-shaped reinforcement portion 44 extending in the longitudinal direction of the main body 42 at the back side of the main body 42. As shown in FIG. 2, the operating member 12 is rotatable, with one end supported by the base 11 and the other end as free end, by inserting a shaft 46 after alignment with the holes 32 and 38 of the bearing wall 27 and first support wall 34, and the bearing holes 43A of the bearing blades 43 and 43.

At the free end side of the main body 42, an L-shaped slit 48 is formed, and the inner side surrounded by the slit 48 is a first operating spot 50 (area, region or portion) for locking the operating member 12, and the outer side, that is, the free end side is a second operating spot 51 for unlocking the operating member 12. A downward hanging wall 53 is integrally provided at the lower side of the first operating spot 50. The downward hanging wall 53, as shown in FIG.

14, is provided so that its surface runs in the lateral direction of the main body 42, and a notch 55 is formed for composing a guide portion from the outer edge (left side edge in the drawing). The notch 55 is inclined so as to be gradually lower in position as the notch depth increases.

At the lower side of the second operating spot 51, a contact member 57 of an isosceles triangular profile is formed. The surface of the contact member 57 is also formed in the lateral direction of the main body 42, and a slope edge 57A is positioned at the lower side. The slope edge 57A is provided at a relative position that crosses with the inclination direction of the notch 55. In the base side of the operating member 12, a spring receiving member 59 is provided, as indicated by dotted line in FIG. 2, at the lower side of the main body 42. This spring receiving member 59 is L-shaped, with the direction of the vertical plane 59A for forming the longer side in the longitudinal direction of the main body 42, and its lower end horizontal plane 59B for forming the shorter side disposed substantially parallel to the main body 42.

Figure 16:
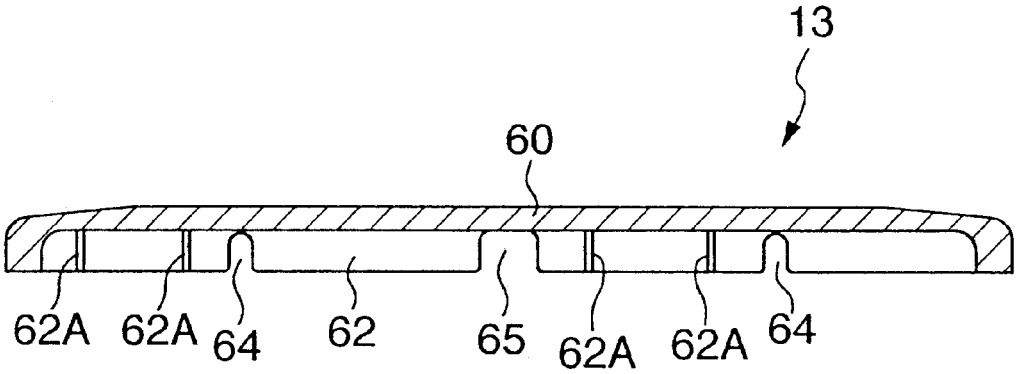
FIG. 16 is a sectional view taken along line D—D in FIG. 18.
Figure 17:
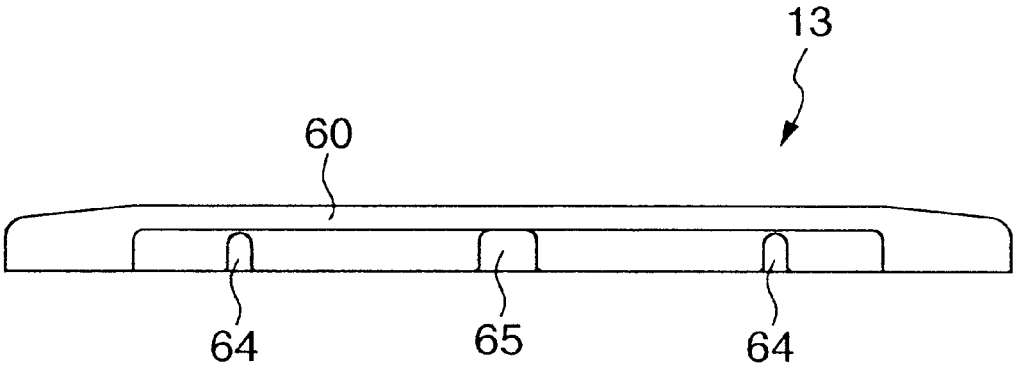
FIG. 17 is a front view of the plate body.
Figure 18:
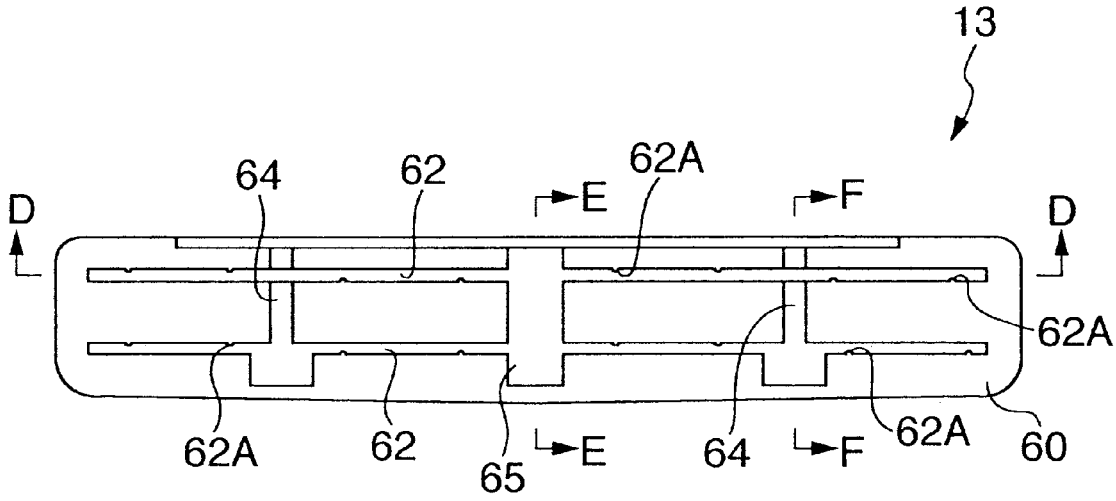
FIG. 18 is a bottom view of the plate body.
Figure 19:
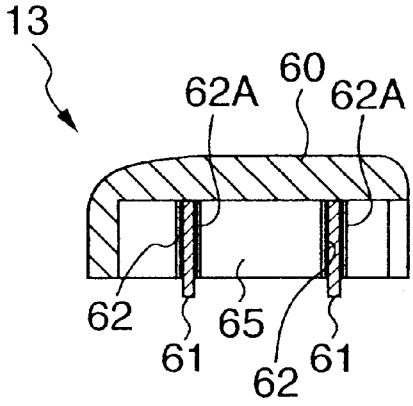
FIG. 19 is an enlarged sectional view taken along line E—E in FIG. 18.
Figure 20:
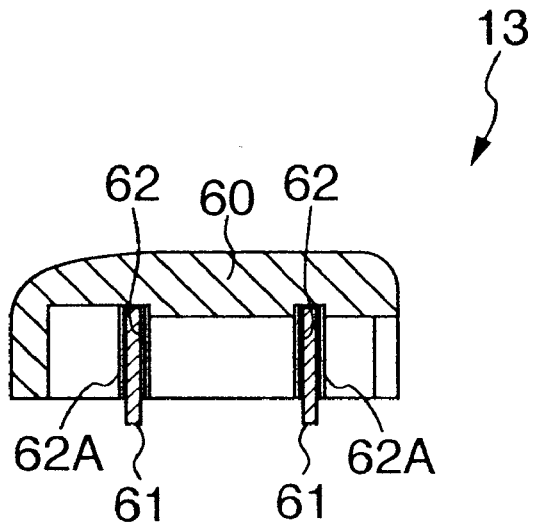
FIG. 20 is an enlarged sectional arrow view taken along line F—F in FIG. 18.
Figure 21:
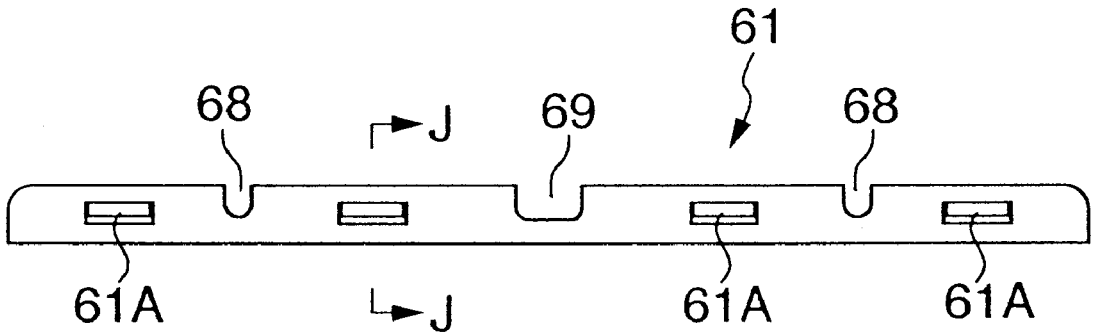
FIG. 21 is a front view of a pressing piece for forming the pressing member.
Figure 22:
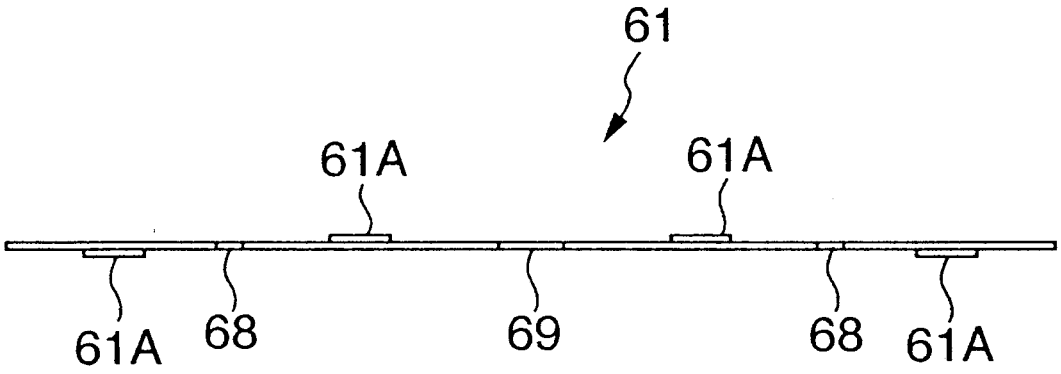
FIG. 22 is a plan view of FIG. 21.
Figure 23:
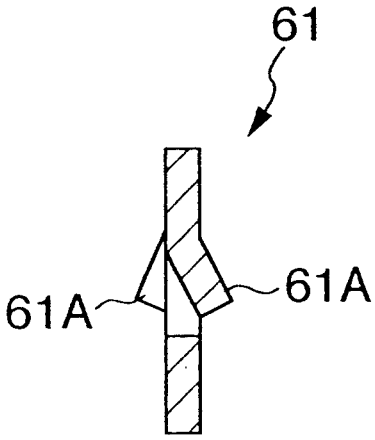
FIG. 23 is an enlarged sectional view taken along line J—J in FIG. 21.
Figure 24:
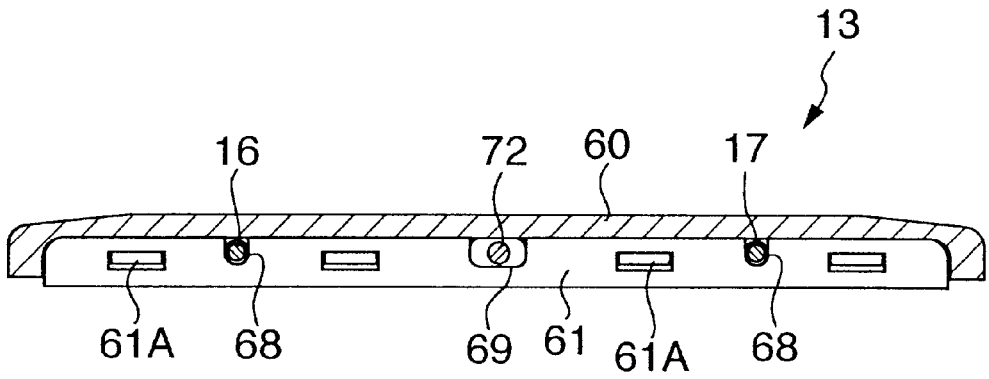
FIG. 24 is a sectional view of the pressing member.

The pressing member 13, as shown in FIG. 15 to FIG. 24, comprises a rectangular plate body 60 and two pressing pieces 61 and 61 attached to the lower side of the plate body 60. At the lower side of the plate body 60, as shown in FIG. 18, two rows of grooves 62 and 62 are formed in the longitudinal direction into which the pressing pieces 61 and 61 can be fit. In the cross direction of these grooves 62 and 62, that is, in the lateral direction of the plate body 60, bearing grooves 64 and 64 for receiving one end side each of the first and second coupling shafts 16 and 17 are formed in two positions in the lateral direction of the plate body 60. At the intermediate position of these bearing grooves 64 and 64, an intermediate bearing groove 65 having a wider groove width than the bearing grooves 64 is provided, and one end side of the spring member 14 is received in this intermediate bearing groove 65. Herein, the bearing grooves 64 and 64 and intermediate bearing groove 65 are provided, as shown in FIG. 17, so as to release one side in the lateral direction of the plate body 60, that is, the operating member 12 side.

At the inner side of the two rows of the grooves 62 and 62, as shown in FIG. 16 and FIG. 18, a plurality of protrusions 62A are formed to extend in the thickness direction of the plate body 60, and these protrusions 62A apply a strong pinching pressure in some areas to the pressing pieces 61 and 61 fitted in each groove 62.

The pressing pieces 61 and 61 are slender metal pieces formed in the same shape. The pressing piece 61 has a shorter side direction width, that is, a vertical direction width as shown in FIG. 19 to FIG. 24, wherein the lower end projects slightly from the lower side of the plate body 60 when it is fitted into the groove 62 of the plate body 60. Inside of the pressing piece 61, raised pieces 61A are formed at appropriate intervals in the longitudinal direction of the pressing piece 61. These raised pieces 61A have an opposing relationship so that the projecting direction may be alternately directed to the opposite side in the longitudinal direction of the pressing piece 61, and therefore when the pressing piece 61 is fitted into the groove 62, each raised piece 61A is housed within the pressing piece 61, and a return force to restore the initial raising angle is applied evenly to the inner wall of the groove 62. The upper edge of the pressing piece 61 is provided with bearing recesses 68 and 68 for forming a space for inserting one end side of the first and second coupling shafts 16 and 17 by mutually acting on the bearing grooves 64 and 64, and an intermediate bearing recess 69 for forming a space for inserting one end side of the spring member 14 by mutually acting on the intermediate bearing groove 65.

Figure 25:
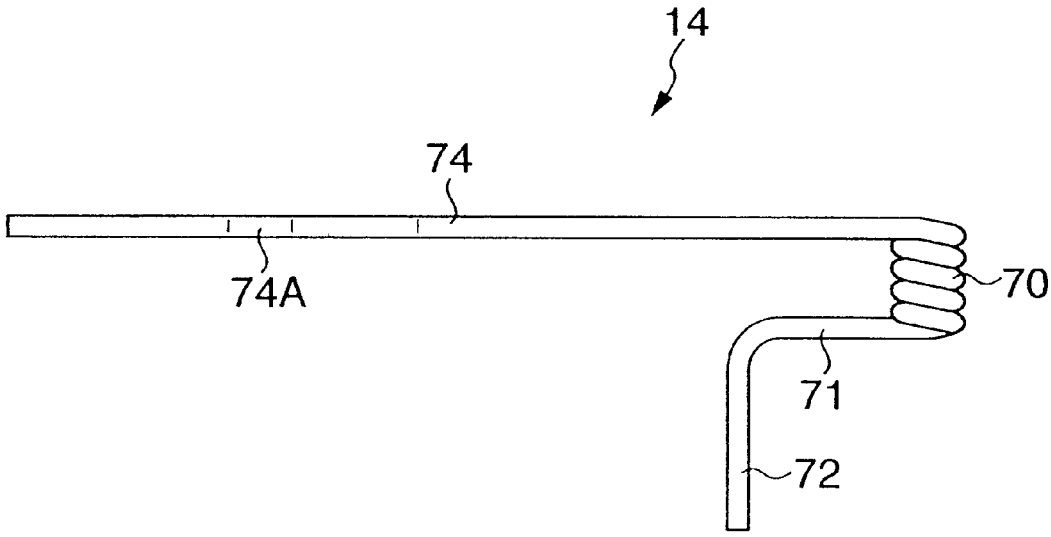
FIG. 25 is a plan view of the spring member.

The spring member 14 comprises, as shown in FIG. 2 and FIG. 25, of a coil portion 70, a linear shaft portion 71 extending from one end side of the coil portion 70, a bent shaft portion 72 extending to the tip of the linear shaft portion 71 and directed in a direction almost orthogonal to the linear shaft portion 71, and an extended shaft portion 74 extending from the other end side of the coil portion 70 for forming the locking means 15. Inside the coil portion 70, as mentioned above, the shaft 46 (see FIG. 2) penetrates, and the bent shaft portion 72 is inserted in the space formed by the intermediate bearing groove 65 and intermediate bearing recess 69 of the pressing member 13.

The extended shaft portion 74 has a length so as to reach the free end side of the operating member 12, being positioned at the lower side of the operating member 12. The extended shaft portion 74 has a slight slope 74A in the middle so as to penetrate through the notch 55 formed in the downward hanging wall 53 of the operating member 12 and pass in a position nearly contacting a slope edge 57A of the contact piece 57.

The pressing member 13 can be, as shown in FIG. 2, coupled to the base 11 and the operating member 12 through the crank-shaped first and second coupling shafts 16 and 17. The first coupling shaft 16 has one end side thereof inserted into the hole 30 formed in the first intermediate wall 26 and the hole 37 formed in the first support wall 34, and the other end side inserted into the space formed by one bearing groove 64 formed at the lower side of the pressing member 13, and the bearing recess 68 of the pressing piece 61. The second coupling shaft 17 has one end side thereof inserted in the hole 31 formed in the second intermediate wall 28 in the base 11 and the hole 40 formed in the second support wall 35, and the other end side inserted into the space formed by other bearing groove 64 formed at the lower side of the pressing member 13, and the bearing recess 68 of the pressing piece 61. Herein, at the tips of the first and second coupling shafts 16 and 17 positioned in the pressing member 13 and the tip of the spring member 14, slip-out prevention parts are preliminarily formed by crimping, not shown, so as not to slip out of the pressing member 13 when they are assembled in the pressing member 13.

The assembling procedure of the binder 10 in this embodiment is described.

When assembling the pressing member 13, by turning the plate body 60 of the pressing member 13 upside down, the one end sides of the first and second coupling shafts 16 and 17 are dropped into the bearing grooves 64, while the bent shaft portion 72 of the spring member 14 is also dropped into the intermediate bearing groove 65. From above, the pressing members 61 and 61 are inserted into the grooves 62 of the plate body 60. At this time, at the end portions of the first and second coupling shafts 16 and 17 and the bent shaft portion 72, since slip-out prevention parts are formed by crimping as mentioned above, the coupling shafts 16 and 17 and bent shaft portion 72 will not slip out of the pressing member 13, and the pressing pieces 61 and 61 are also fitted firmly into the grooves 62 so as not to not fall out.

Consequently, the other end side of the first coupling shaft 16 is inserted into the holes 30 and 37 of the first intermediate wall 26 and first support wall 34, and the other end side of the second coupling shaft 17 is inserted into the holes 31 and 40 of the second intermediate wall 28 and second support wall 35. At the same time, the extended shaft portion 74 of the spring member 14 is set along the lower side of the operating member 14, and the coil portion 70 is positioned between the bearing blades 43 and 43 of the operating member 12. The shaft 46 is inserted by aligning the bearing holes 43A of the bearing blades 43 and 43 and the holes 32 and 38 formed in the bearing wall 27 and first support wall 34.

Finally, by crimping the tips of the first and second coupling shafts 16 and 17 projecting outside of the first support wall 34 and second support wall 35, and the tip of the shaft 46, slip-out prevention parts are formed, and the binder 10 is complete.

In the binder 10 thus assembled, by pressing the first operating spot 50 from above to the setting plane 20 side and rotating the operating member 12 in a substantially horizontal direction, the extended shaft portion 74 follows the upper shape of the hook portion 39 and moves from the initial axial position (dotted line position in FIG. 14) slightly to the right side, that is, the pressing member 13 side, and rides over the hook portion 39, at which time it returns to the initial axial position and is caught by the hook portion 39 to be locked. At the same time, the pressing member 13 is set on the setting plane 20 of the base 11 at the binding position.

When releasing the binding action by the pressing member 13, that is, when unlocking the operating member 12, the second operating spot 51 is only pressed and operated to the setting plane 20 side, just like the first operating spot 50. By this pressing operation, the second operating spot 51 is displaced in a direction of lowering the plane position independently, by formation of the slit 48 as mentioned above. By this displacement, being set lower than the position of the slope edge 57A of the contact member 57 disposed at the lower side, the extended shaft portion 74 contacting therewith is displaced downward to the right side in FIG. 14 so as to be disengaged from the hook portion 39 by this displacement.

Thus, when the extended shaft portion 74 is disengaged from the hook portion 39 to be unlocked, the operating member 12 is lifted by the spring force of the spring member 14 so as to set the pressing member 13 free. At the same time, the extended shaft portion 74 returns to the initial axial position.

Therefore, according to such a configuration of the first embodiment, when locking and unlocking by the extended shaft portion 74 and hook portion 39, it is only necessary to press the free end side of the operating member 12 toward the setting plane 20 side, so the operation is very simple.

Other embodiments of the invention are described below. In the following descriptions, the same or similar parts as in the first embodiment are identified with same reference characters, and their description is omitted or simplified.

Second Embodiment

Figure 26:
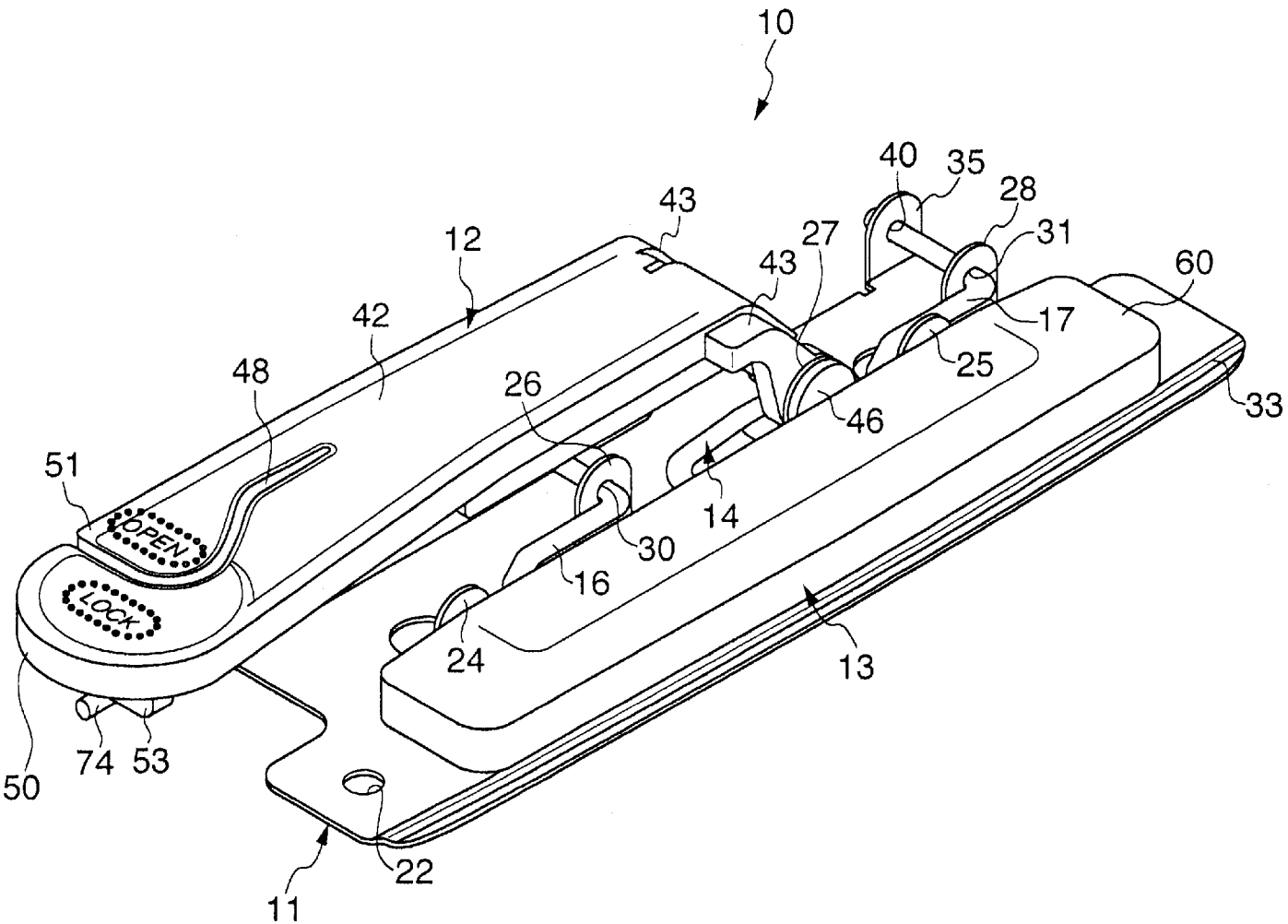
FIG. 26 is a schematic perspective view showing an entire structure of a binder according to a second embodiment.
Figure 27:
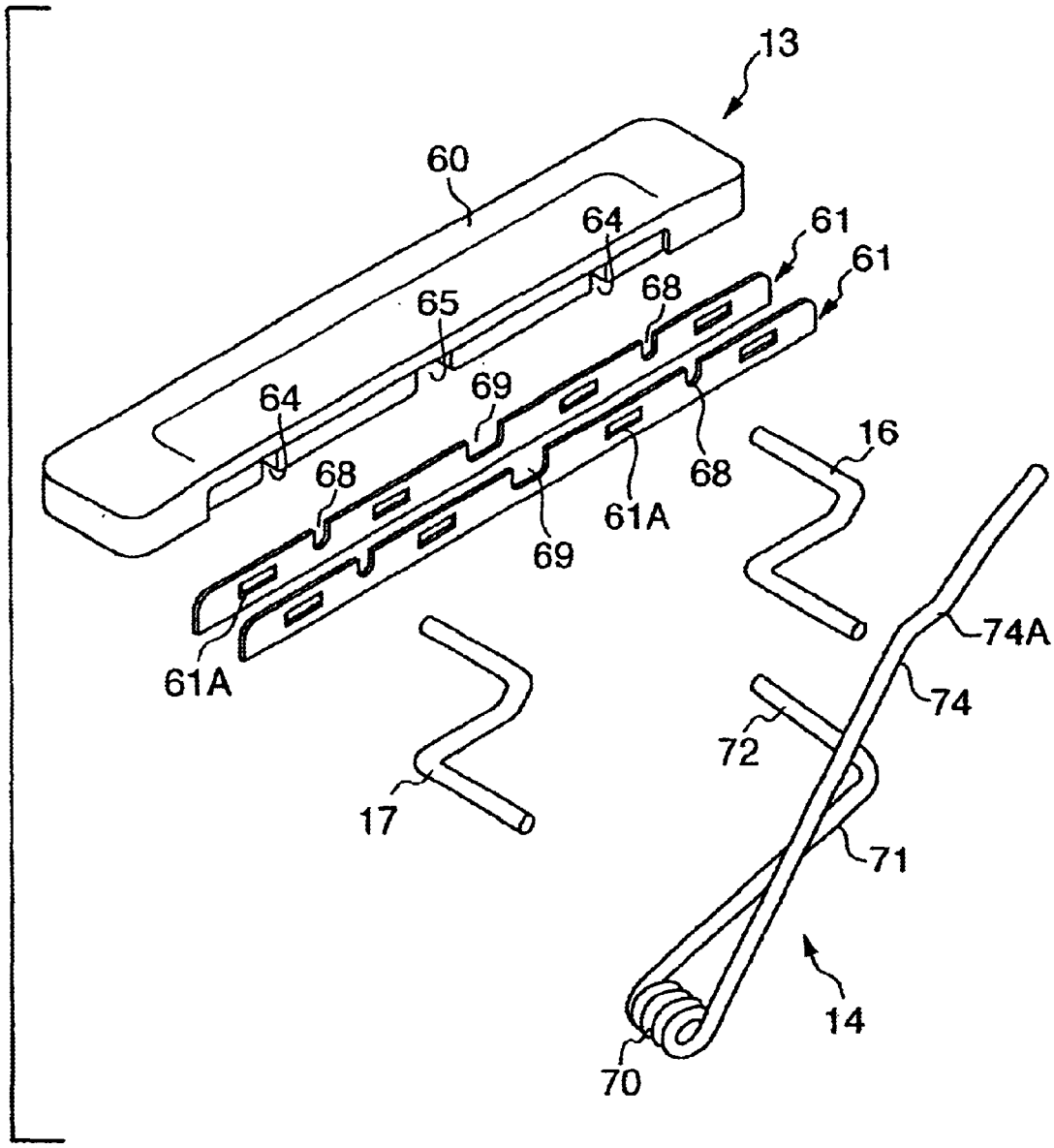
FIG. 27 is a partial schematic exploded perspective view of FIG. 26 as seen from the side opposite of FIG. 2.
Figure 28:
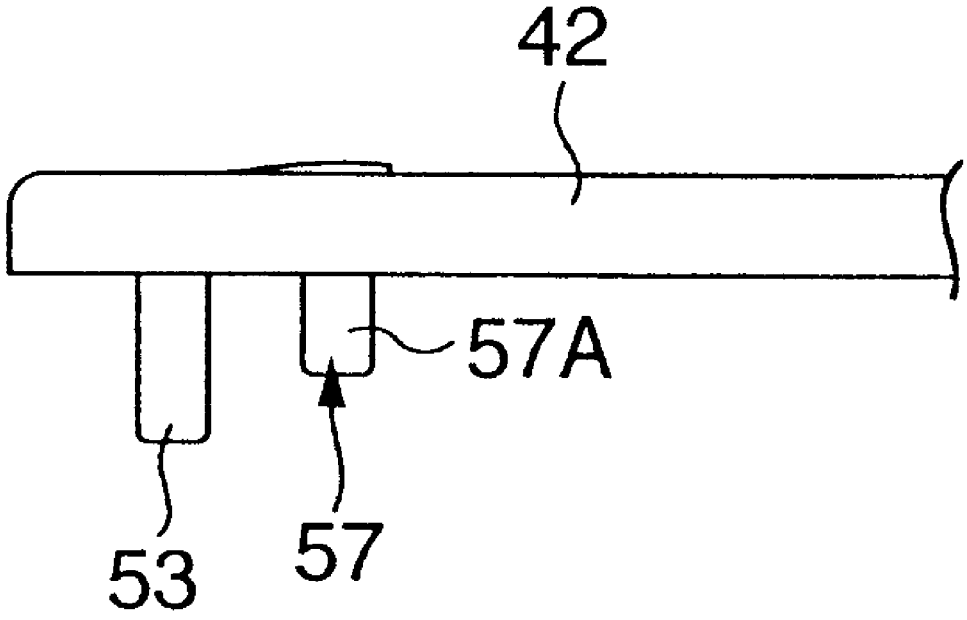
FIG. 28 is a side view showing a free end side spot of the operating member according to the second embodiment.
Figure 29:
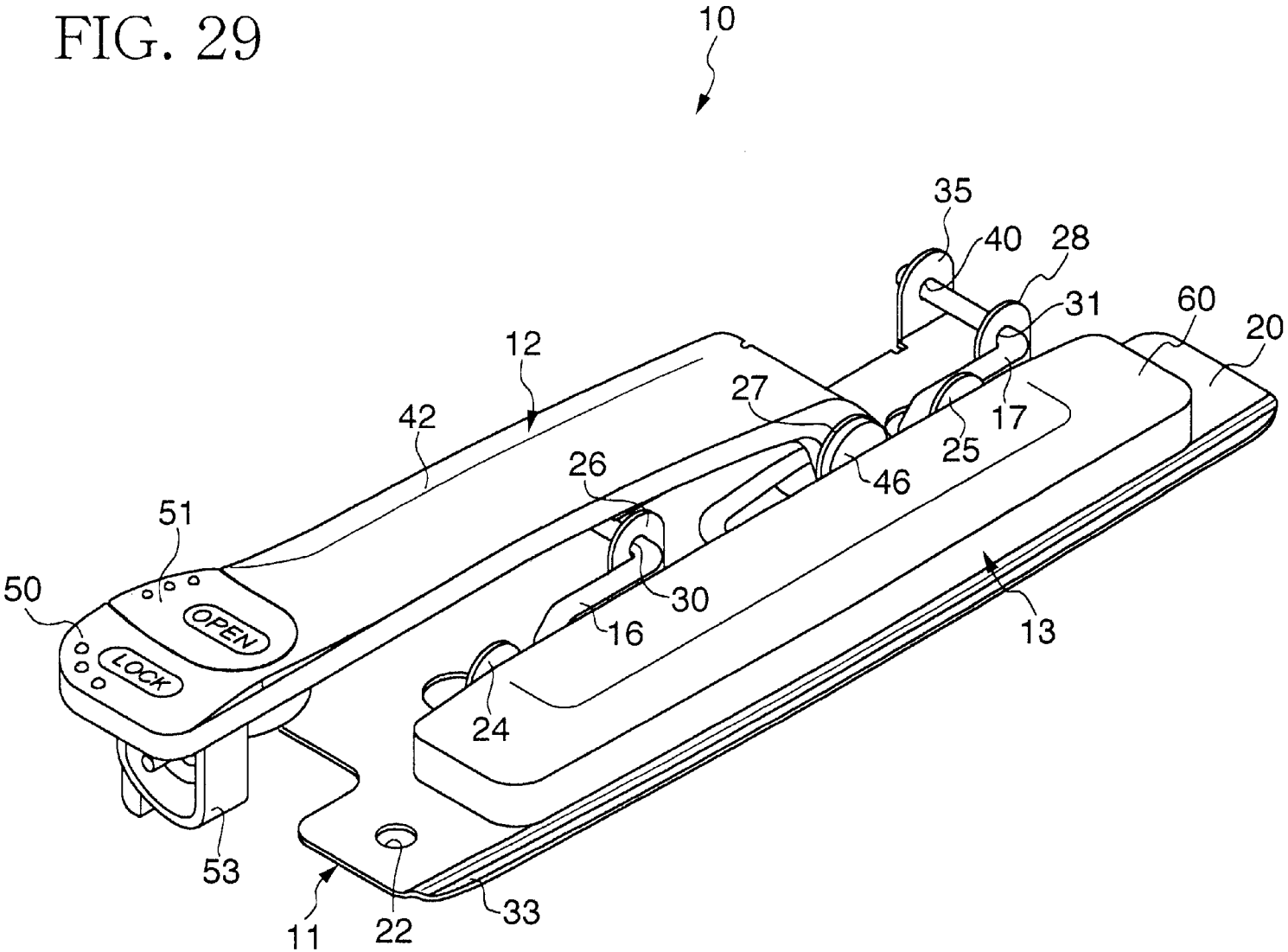
FIG. 29 is a schematic perspective view showing an entire structure of a binder according to a third embodiment of the present invention.
Figure 30:
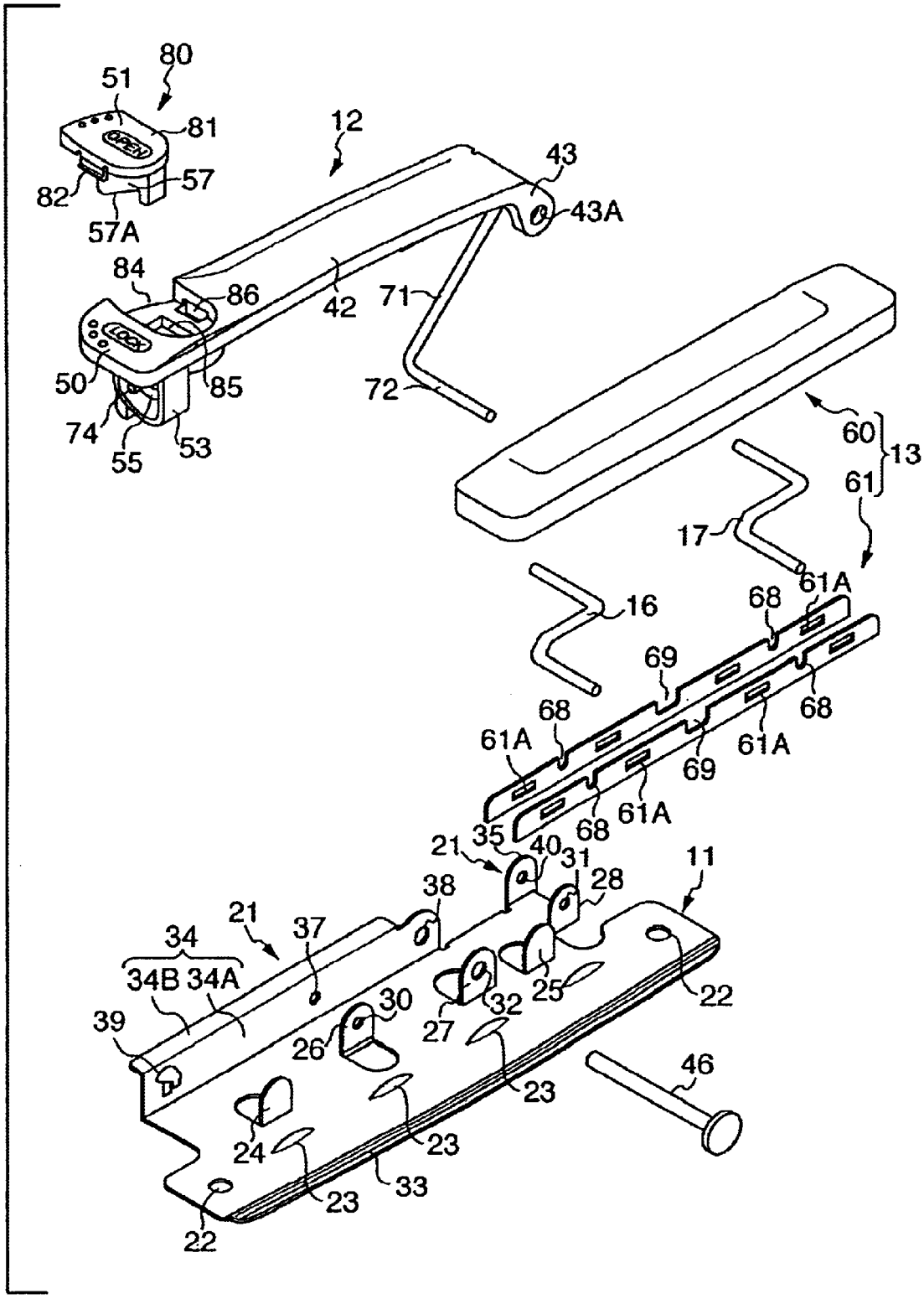
FIG. 30 is an exploded perspective view of the binder according to the third embodiment.
Figure 31:
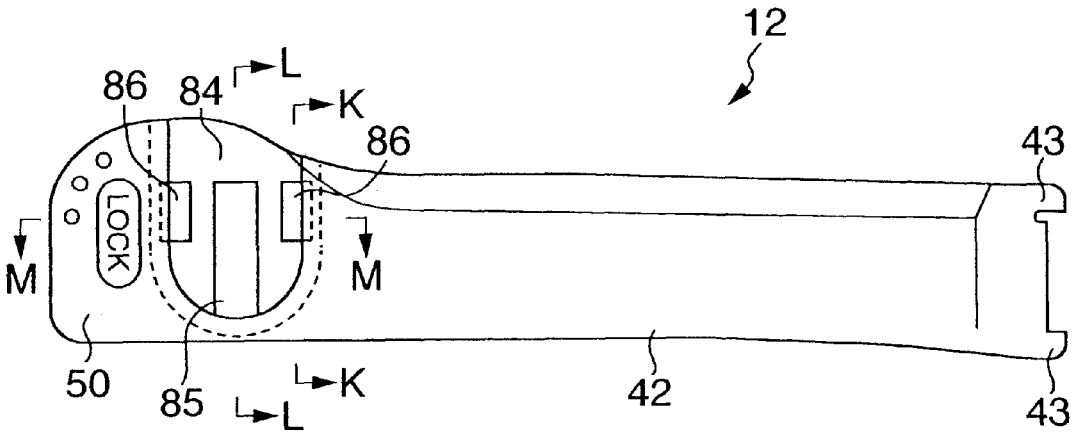
FIG. 31 is a plan view of the operating member according to the third embodiment.
Figure 32:
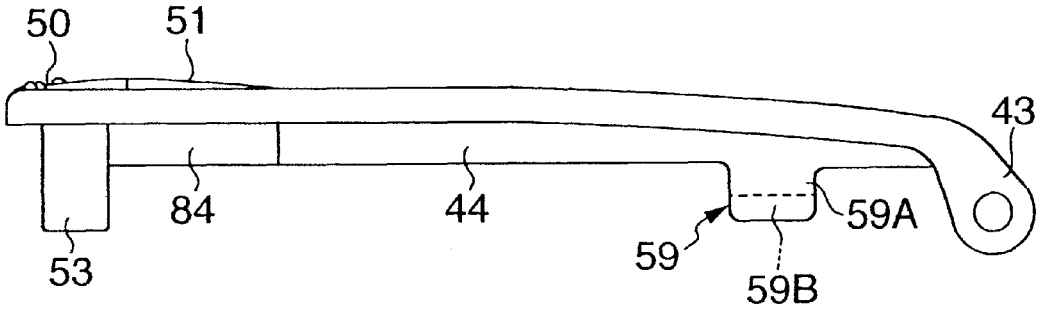
FIG. 32 is a front view of the operating member according to the third embodiment.
Figure 33:
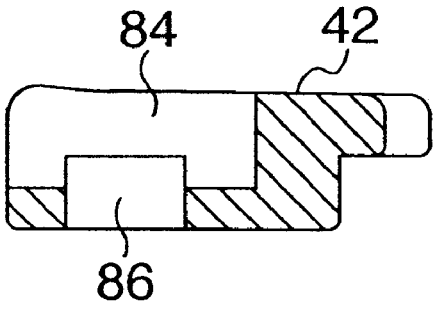
FIG. 33 is an enlarged sectional view taken along line K—K in FIG. 31.
Figure 34:
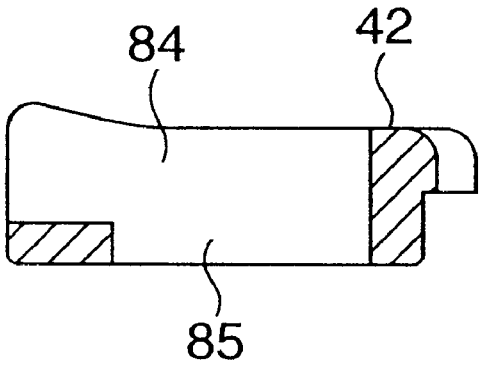
FIG. 34 is an enlarged sectional view taken along line L—L in FIG. 31.
Figure 35:
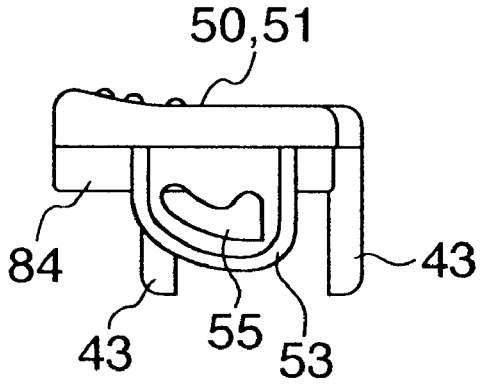
FIG. 35 is a left side view of FIG. 31.
Figure 36:
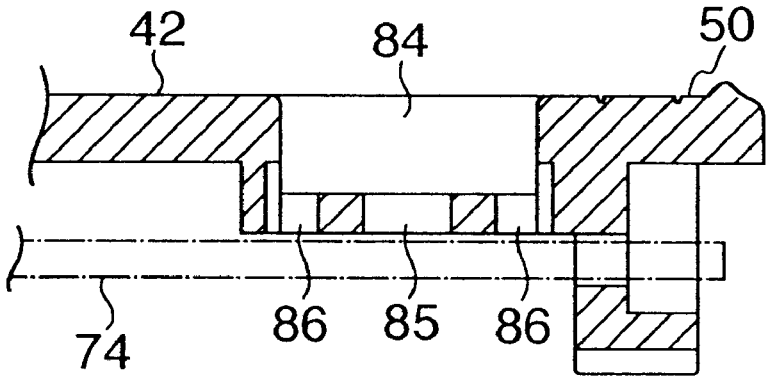
FIG. 36 is an enlarged sectional view taken along line M—M FIG. 31.

FIG. 26 to FIG. 28 show a binder 10 in a second embodiment. This binder 10 is characterized by changing the position where the slit 48 is formed and inverting the positions of the first operating spot 50 and second operating spot 52. Accordingly, the design is changed, that is, the downward hanging wall 53 is provided at the free end side of the operating member 12, and the contact member 57 is provided at the inside thereof. The other configuration is substantially the same as in the first embodiment.

In this type of second embodiment, as well, the same advantages as in the first embodiment are obtained.

Third Embodiment

FIG. 29 to FIG. 36 show a third embodiment. In this embodiment, the first and second operating spots 50 and 51 are disposed in the same positions as in the second embodiment, and the second operating spot 51 is formed of separate part.

More specifically, the second operating spot 51 comprises a piece member 80 made of a separate part. This piece member 80 comprises a flat portion 81, a contact member 57 hanging down from the lower side of the flat portion 81, and a pair of pawl members 82 hanging down from two locations on the outer circumference of the flat portion 81 from the intermediate position of the contact member 57.

Near the free end of the main body 42 which composes the operating member 12, a dent 84 for receiving the piece member 80 is formed. Within the spot of the dent 84, a slot 85 for receiving the contact member 57 movably in the vertical direction is formed, and at both sides of the slot 85 (at right and left sides in FIG. 31), mounting holes 86 and 86 for holding the pawl members 82 to prevent them from falling out upward are formed.

The piece member 80 is movable vertically while fall-out is within the dent 84 is controlled, and when this piece member 80 descends, the lower edge 57A of the contact member 58 pushes down the extended shaft portion 74 (see FIG. 36) so that the extended shaft portion 74 is unlocked from the hook portion, not shown, at the base side. The piece member 80 is designed to be kept in the highest position while pressing force is not applied from the upper side, and a specific push-down space is formed between the lower side of the flat portion 81 and the upper side of the dent 84. The other configuration is substantially the same as in the first and second embodiments.

According to the third embodiment, since the second operating spot 51 is composed of the piece member 80 made of a separate part from the main body 42, the pressing operating force of the second operating spot 51 acts naturally and smoothly as the descending force of the piece member 80 so that the extended shaft portion 74 may be more reliably disengaged from the locked position.

Fourth Embodiment

Figure 37:
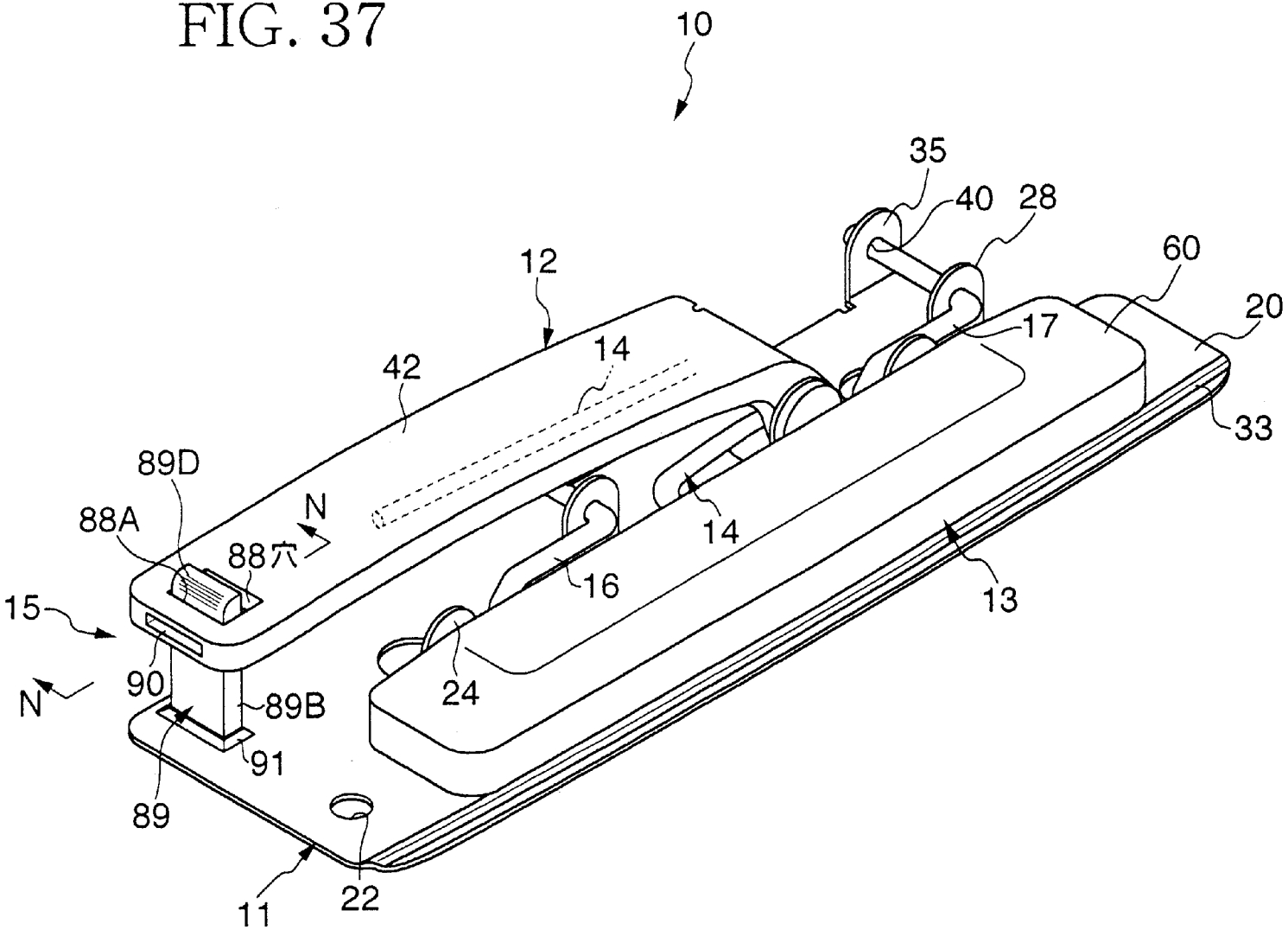
FIG. 37 is a schematic perspective view showing an entire structure of a binder according to a fourth embodiment of the present invention.
Figure 38:
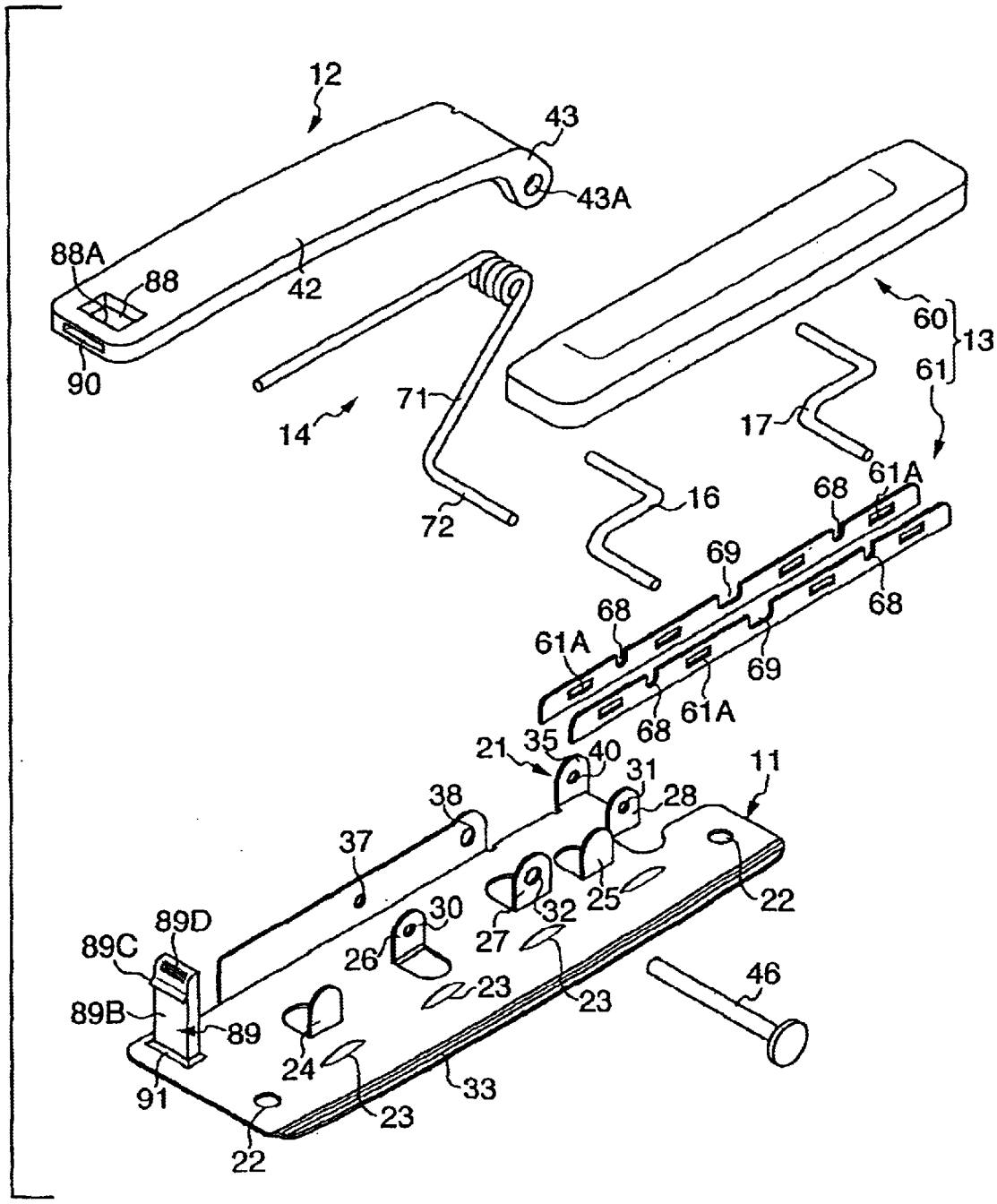
FIG. 38 is an exploded perspective view of FIG. 37.
Figure 39:
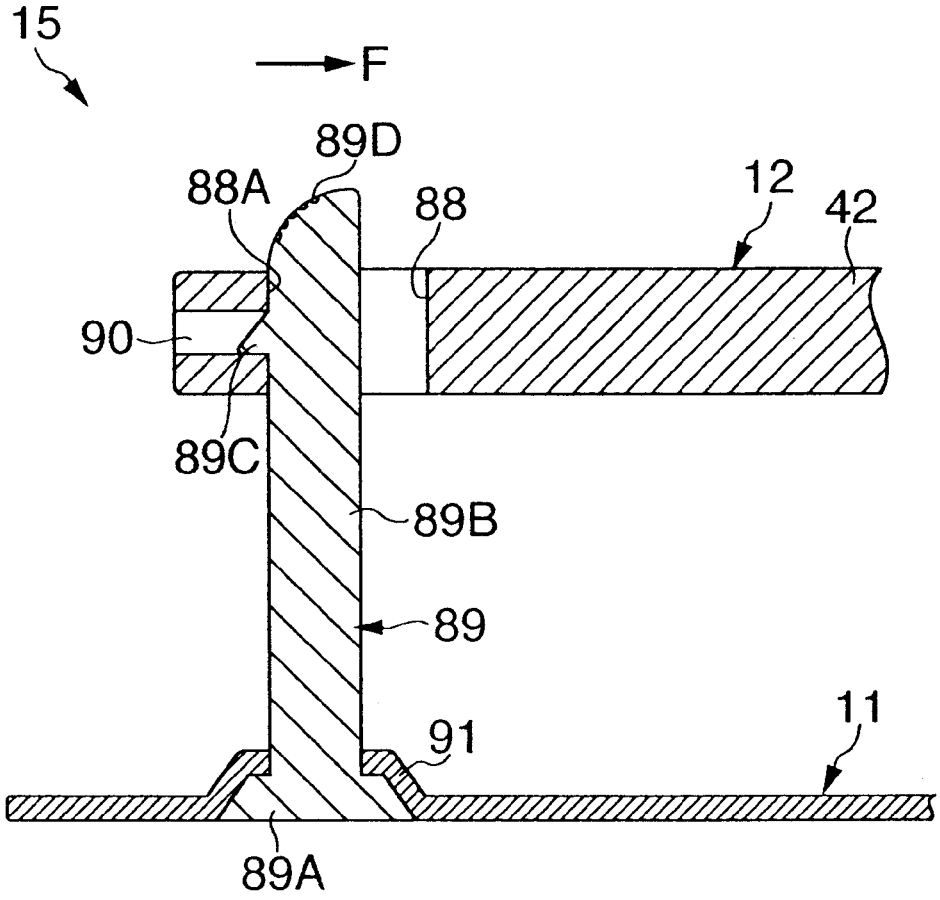
FIG. 39 is an enlarged sectional view taken along line N—N in FIG. 37.

FIG. 37 to FIG. 39 show a fourth embodiment of the invention. In this embodiment, the composition of the locking means 15 is different, being designed to unlock the operating member 12 by operating the locking means 15 as specified.

That is, the locking means 15 has a hole 88 as a first lock forming portion formed at the free end side of the operating member 12, and a standing member 89 as a second lock forming portion to be inserted in this hole 88. Between the free end side inner side 88A for composing the edge of the hole 88 and the free end of the operating member 12, a passage 90 communicating with the hole 88 is formed.

The standing member 89, as shown in an enlarged view in FIG. 39, comprises a base portion 89A to be received in a holed protrusion 91 formed in the base 11, a protrusion 89B of a square column projecting on the base 11 from the upper side of the base portion 89A, and a pawl portion 89C provided on the upper outer side of the protrusion 89B to be hooked in the passage 90. The protrusion 89B is formed in such length or height that upper end thereof may project above the upper side of the operating member 12 when the operating member 12 is set in a locked position. In the protrusion 89B, meanwhile, the thickness in the lateral direction in FIG. 39 is set smaller than the width of the hole 88 in the same direction, such that when an external force is applied from the direction of arrow F by touching the fingertip to the upper curvature of the protrusion 89B, the upper portion of the protrusion 89B is displaced to the right side so that the engagement between the pawl portion 89C and the passage 90 can be released. At this time, since a slip preventive portion 89D of a groove is provided in the upper curvature of the protrusion 89B, when external force is applied the fingertip does not slip, and the external force can be applied securely. The other configuration is the same as in the foregoing embodiments.

Thus, according to the fourth embodiment, locking can be released only by applying a force in one direction, that is, direction F with respect to the standing member 89. Moreover, as compared with the foregoing embodiments, the structure is simple and the manufacturing cost can be drastically reduced. Furthermore, since the standing member 89 is designed to extend by penetrating through the inside of the operating member 12, when unlocked by a fingertip, the fingertip is positioned at the upper side of the operating member 12, and therefore the operating member 12 is prevented from popping up forcibly by the force of the spring member 14.

Fifth Embodiment

Figure 40:
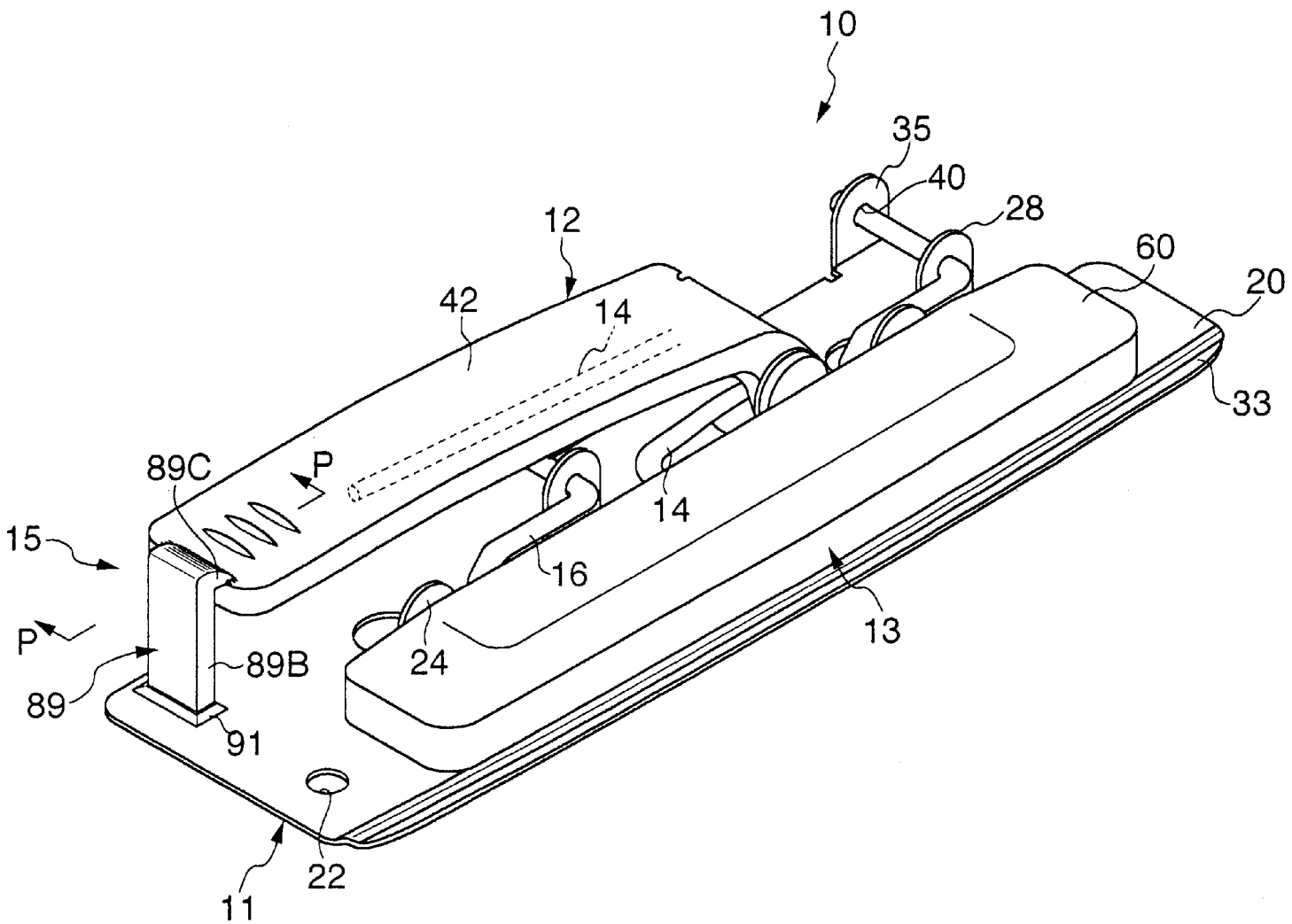
FIG. 40 is a schematic perspective view showing an entire structure of a binder according to a fifth embodiment of the present invention.
Figure 41:
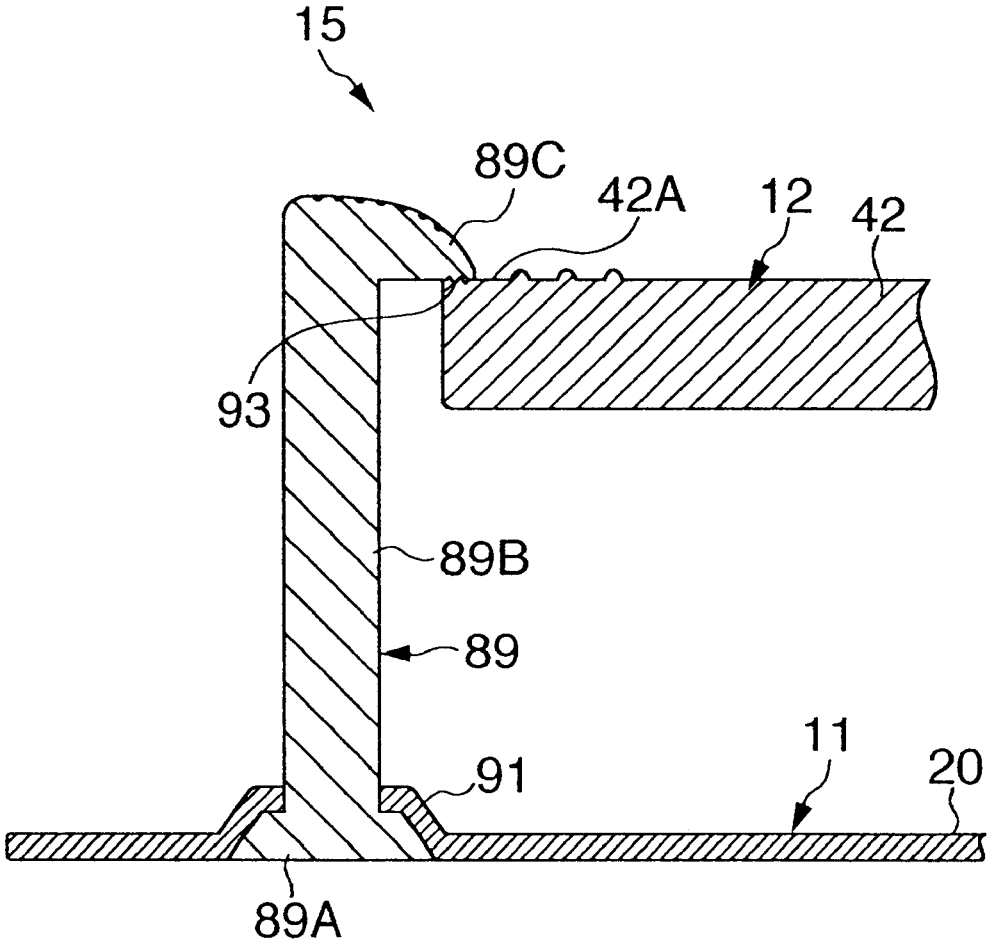
FIG. 41 is an enlarged sectional view taken along line P—P in FIG. 40.
Figure 42:
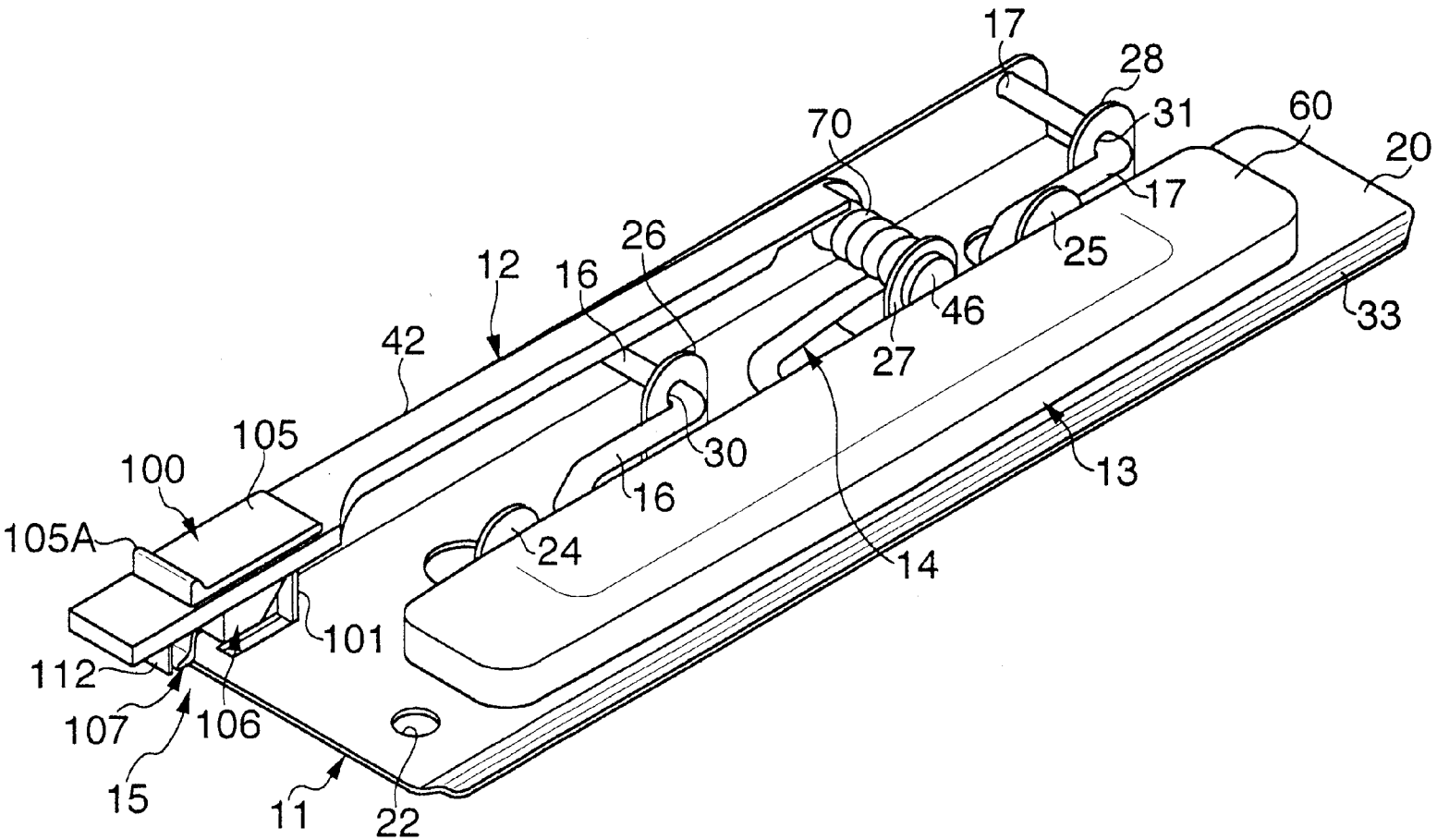
FIG. 42 is a schematic perspective view showing a locked state of an operating member and/or an entire structure of a binder according to a sixth embodiment of the present invention.
Figure 43:
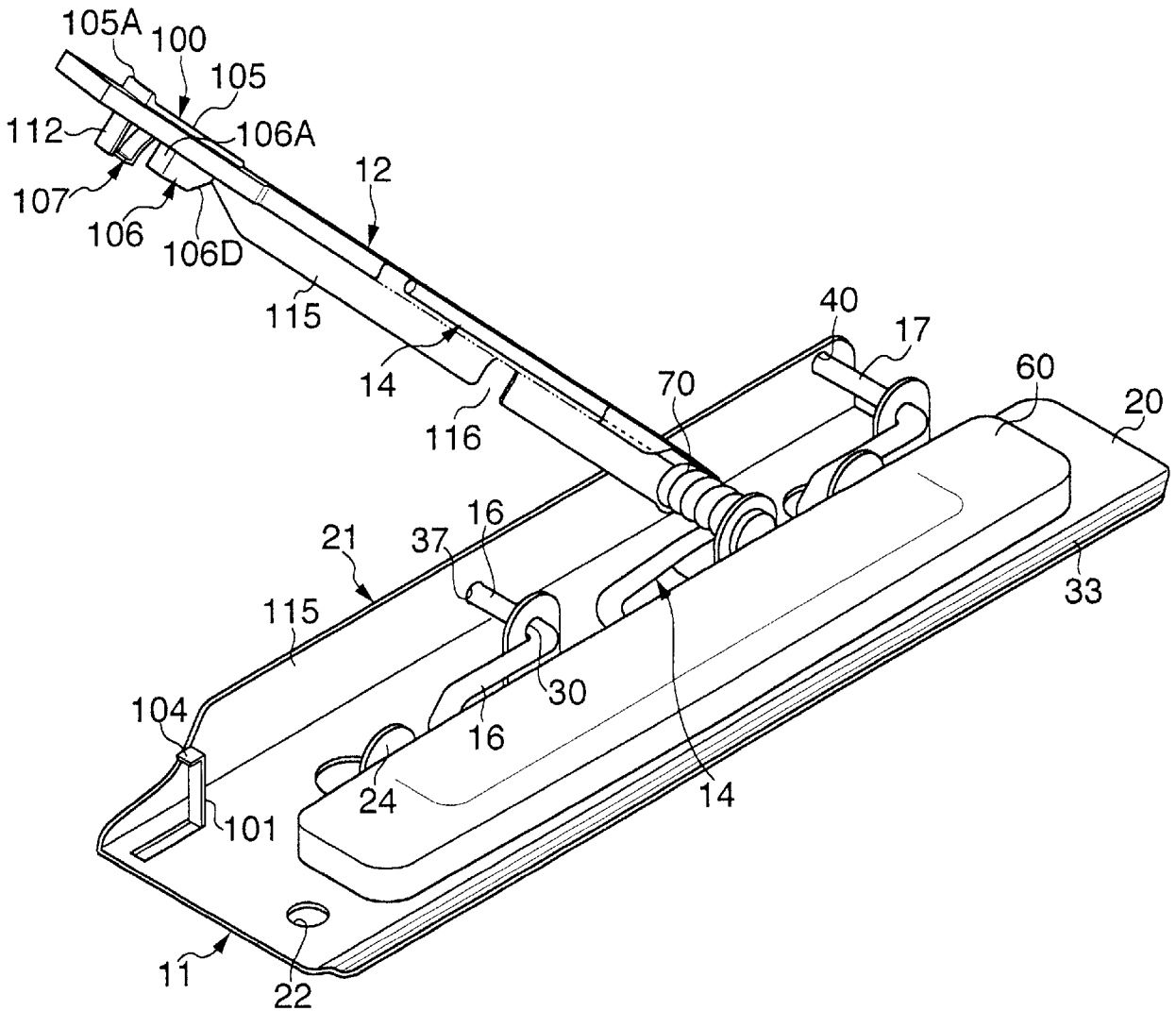
FIG. 43 is a schematic perspective view showing an unlocked state the operating member of the binder according to the sixth embodiment.

FIG. 40 and FIG. 41 show a fifth embodiment of the invention. This invention relates to a modified example of the locking means 15 of the fourth embodiment, and is characterized by locking the operating member 12 without a hole in the operating member 12.

That is, the free end side upper side 42A at the outer edge of the operating member 12 is composed as the first lock forming portion, whereas the second lock forming portion is composed of the standing member 89 provided at the base side. The standing member 89 has a pawl portion 89C to be hooked on the free end side upper side 42A disposed at its upper inner side. With the protrusion 89B of the standing member 89 substantially perpendicular, the pawl portion 89C is hooked onto the free end side upper side 42A and the pawl portion 89C is displaced to the left side in FIG. 41 so that the operating member 12 is unlocked. At the joining surface of the pawl portion 89C and free end side upper side 42A, an engaging portion 93 of zigzag teeth is formed, so that the engagement by the pawl portion 89C does not release unexpectedly.

Therefore, according to the fifth embodiment, in addition to the advantages obtained in the fourth embodiment, the shape of the operating member 12 can be simplified. Moreover, locking can be released by simply pulling the tip side of the standing member 89 with a fingertip so operating force can be applied effortlessly. Furthermore, unintended unlocking can be avoided by the engaging portion 93 provided between the pawl portion 89C and free end side upper side 42A.

Sixth Embodiment

Figure 44:
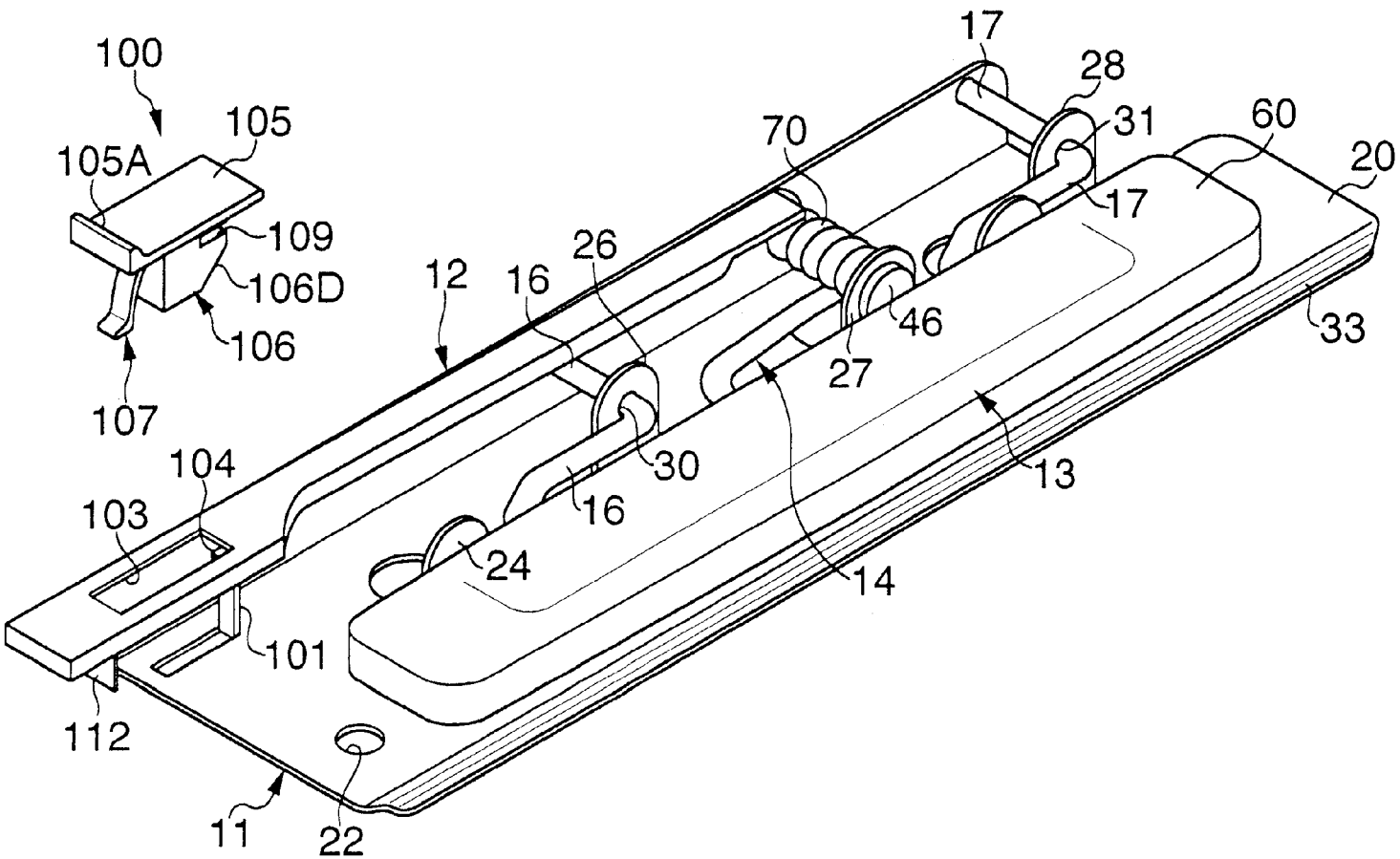
FIG. 44 is a schematic perspective view showing an exploded state of a slide member.
Figure 45:
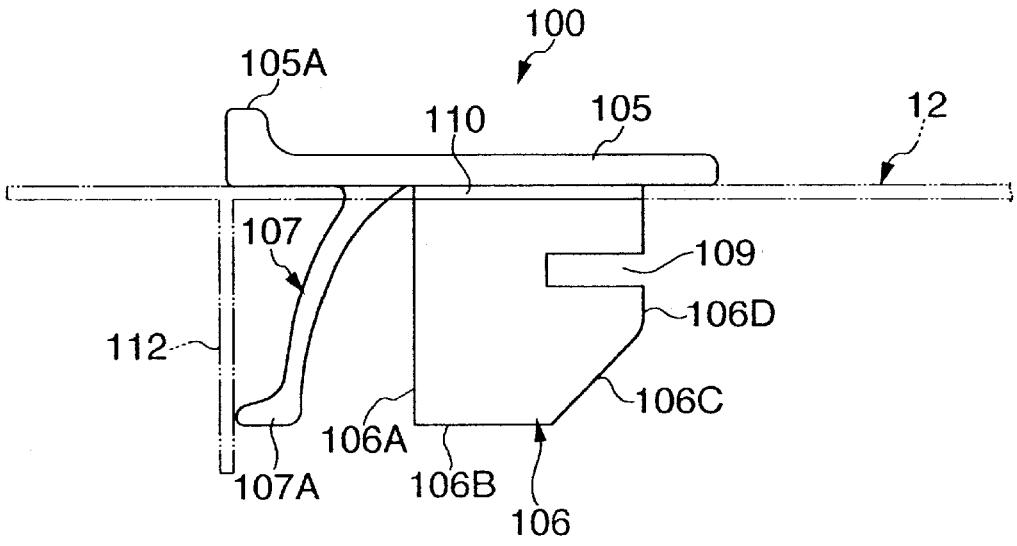
FIG. 45 is a side view of the slide member.
Figure 46:
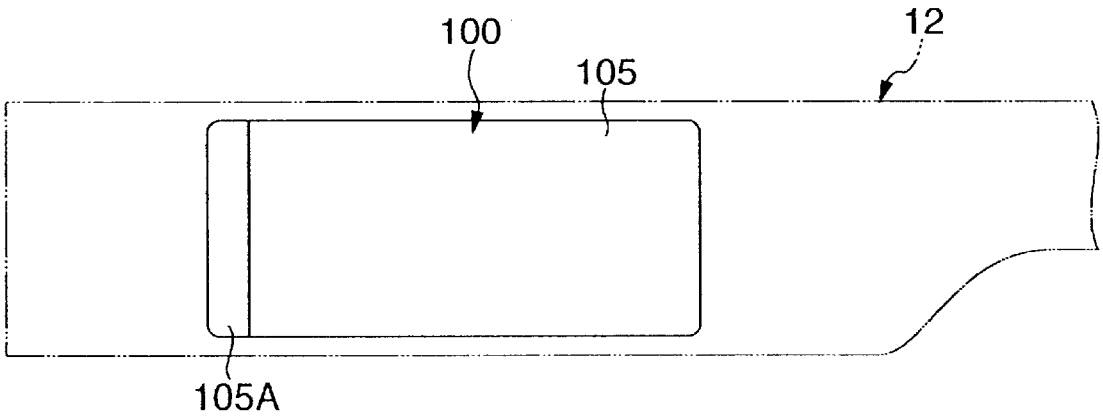
FIG. 46 is a plan view of the slide member.
Figure 47:
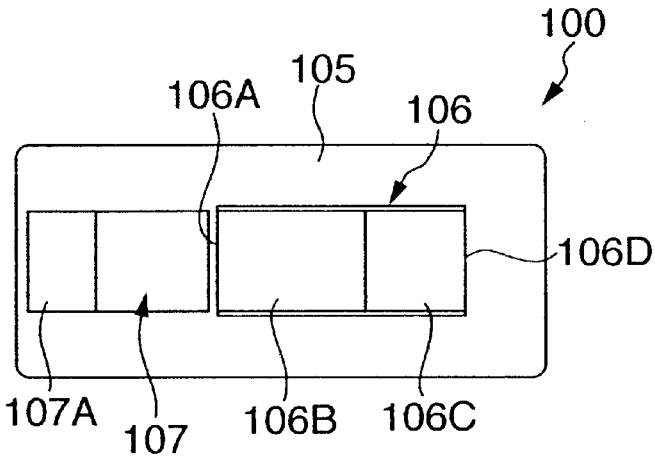
FIG. 47 is a bottom view of the slide member.

FIG. 42 to FIG. 54 show a sixth embodiment of the invention. This embodiment relates to a modification of the locking means 15 in the fourth and fifth embodiments. That is, the locking means 15 in the sixth embodiment comprises a slide member 100 for composing the first lock forming portion disposed at the free end side of the operating member 12, and a standing member 101 for composing the second lock forming portion disposed at the base 11. The slide member 100 is, as shown in FIG. 44, fitted so as not to fall off in a rectangular mounting hole 103 provided at the free end side of the operating member 12, and the standing member 101 is composed by partially raising the side of the base 11.

The slide member 100 comprises, as shown in FIG. 45 to FIG. 48, a flat slide plate 105 positioned at the upper side of the operating member 12, a piece member 106 hanging down from the lower side of the slide plate 105, and an accompanying arm spring 107. The slide plate 105 has a wider area than the mounting hole 103, and a protrusion 105A is provided at one end side. When the slide plate 105 is pulled to the free end side of the operating member 12 by a fingertip, relative slipping of the fingertip and the slide plate 105 is prevented so that the operating effort can be securely applied to the slide plate 105.

Figure 48:
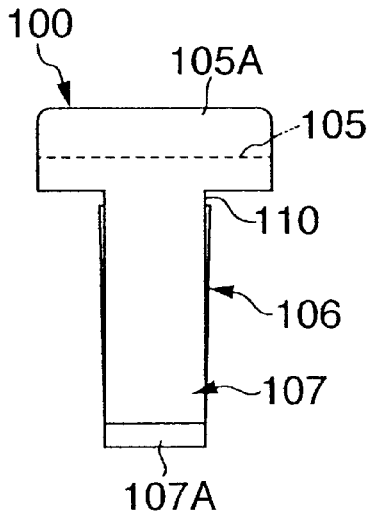
FIG. 48 is a left side view of FIG. 45.
Figure 49A:
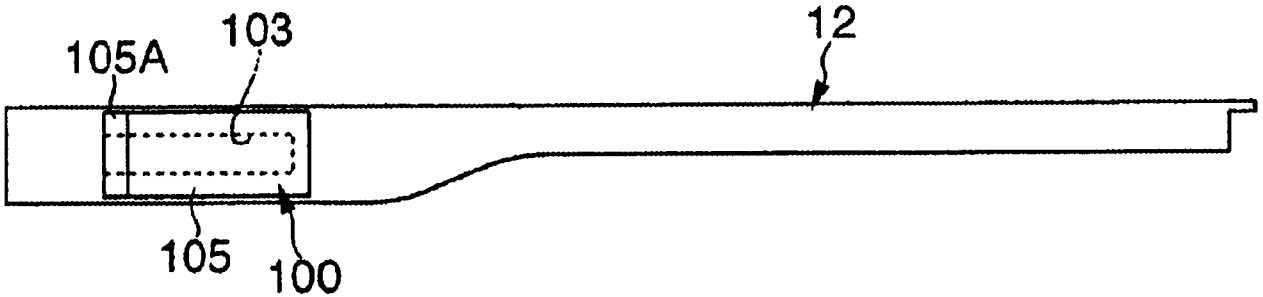
FIG. 49(A) is a plan view of the operating member.
Figure 49B:
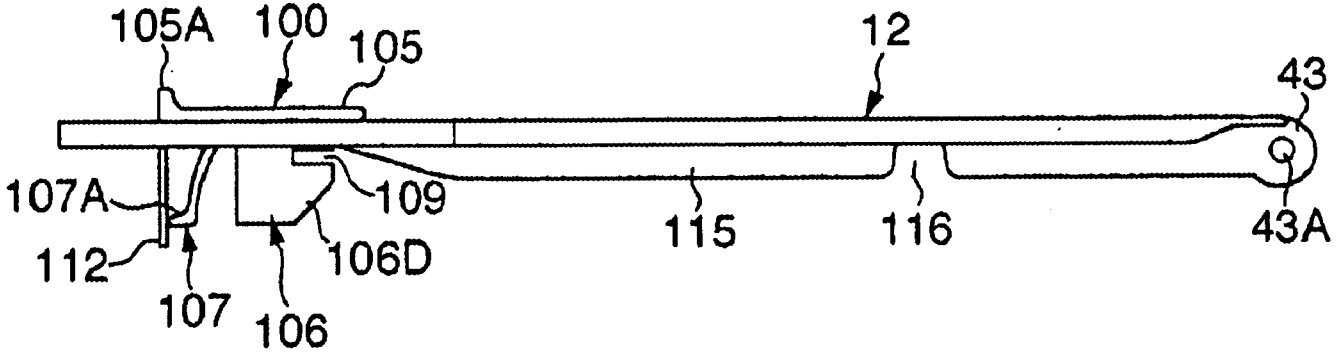
FIG. 49(B) is the front view thereof.
Figure 50A:
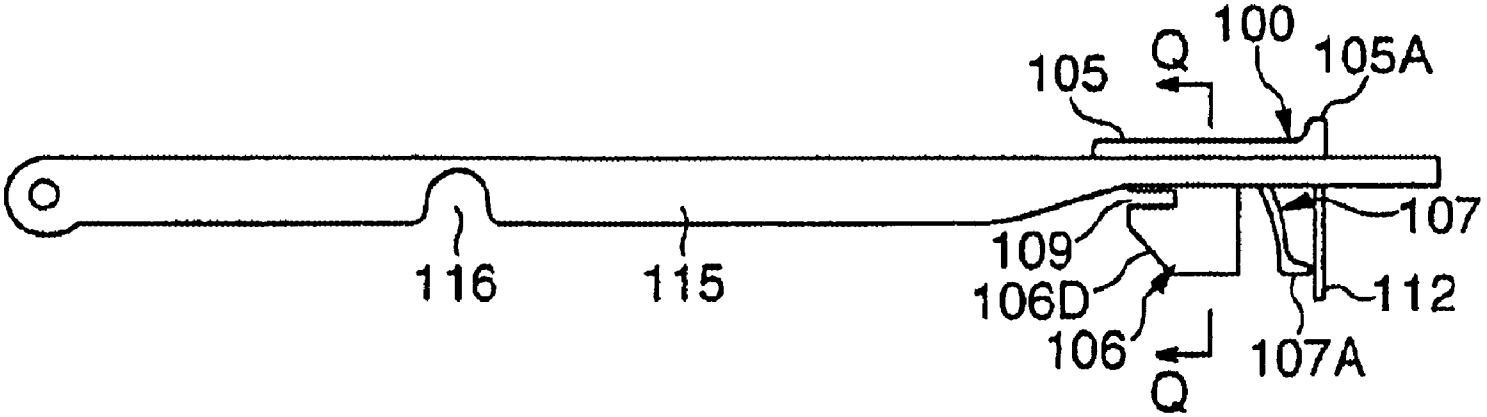
FIG. 50(A) is a back side view of the operating member.
Figure 50B:
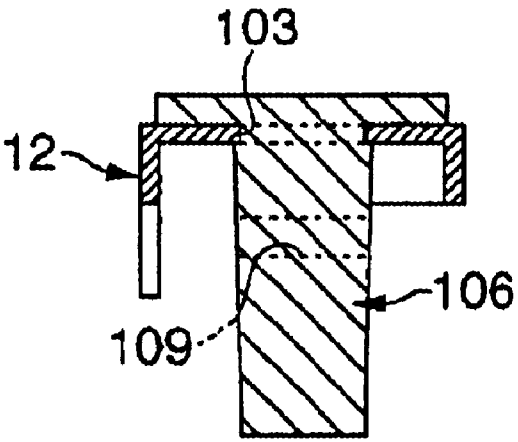
FIG. 50(B) is an enlarged sectional view taken along line Q—Q in FIG. 50(A)

The piece member 106 is a plate having a length of about ½ of the length in the longitudinal direction of the slide plate 105 at the lower side of the slide plate 105, and a thickness less than the shorter side direction width of the slide plate 105. The surface of the plate is set on both sides in longitudinal direction of the slide plate 105. In this piece member 106, one end at the free end side of the operating member 12 is an outside hanging edge 106A extending in a direction substantially orthogonal to the surface of the slide plate 105, and the other end at the opposite side is an inside hanging edge 106D having a slope edge 106C against the lower edge 106B. The inside hanging edge 106D has a notch 109 formed from the inside hanging edge 106D toward the outside hanging edge 106A. In addition, the piece member 106 has a shallow groove 110 formed at the slide plate 105 side as shown in FIG. 48 and FIG. 50(B), and the plate thickness of the lower end side is set somewhat less, and is therefore easier to install in the mounting hole 103. After fitting the slide member 100 in the mounting hole 103, the operating member 12 is prevented from coming out of the mounting hole 103 while allowing slide movement in the longitudinal direction.

The arm spring 107 has its base end positioned near the piece member 106, and its tip portion 107A is directed in a direction away from the piece member 106. The tip portion 107A of the arm spring 107 is bent in a direction substantially parallel to the slide plate 105, and its leading edge is provided so as to contact with the raised piece 112 for forming the mounting hole 103.

The standing member 101 for forming the second lock forming portion has a pawl portion 104 bent in a direction for hooking onto the notch 109 of the piece member 106. This standing member 101 is formed by partially raising the surface of the base 11, or a standing member separately formed without this raising may be fixed through welding or other means.

The operating member 12 in the sixth embodiment is formed by processing a metal plate. This operating member 12 is composed by forming a side wall 115 hanging down from the end in the longitudinal direction of the main body 42 from the bearing blade 43 of the flat main body 42 to the vicinity of the mounting hole 103. In substantially the middle of the side wall 115, a notch recess 116 is provided so as to avoid positional interference with the coupling shaft 16. The support wall 21 positioned at the end of the base 11 comprises a standing piece extending in the longitudinal direction of the base 11, and the portion adjacent to the standing member 101 is formed so as to be lower in height.

Figure 51:
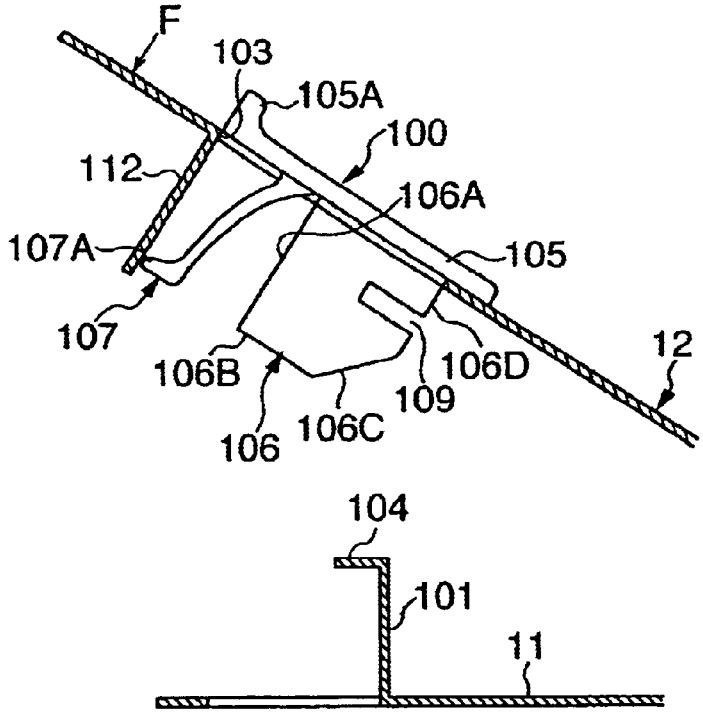
FIG. 51 is a schematic sectional view explaining an initial operating method for locking the operating member.
Figure 52:
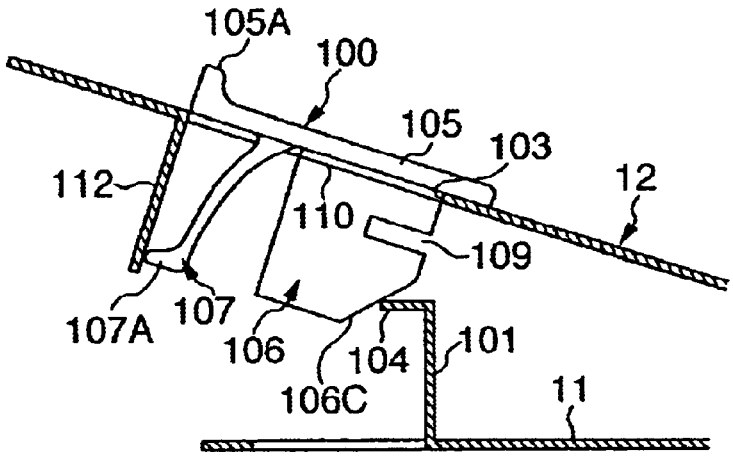
FIG. 52 is a sectional view showing the slide member in a state contacting the standing member.
Figure 53:
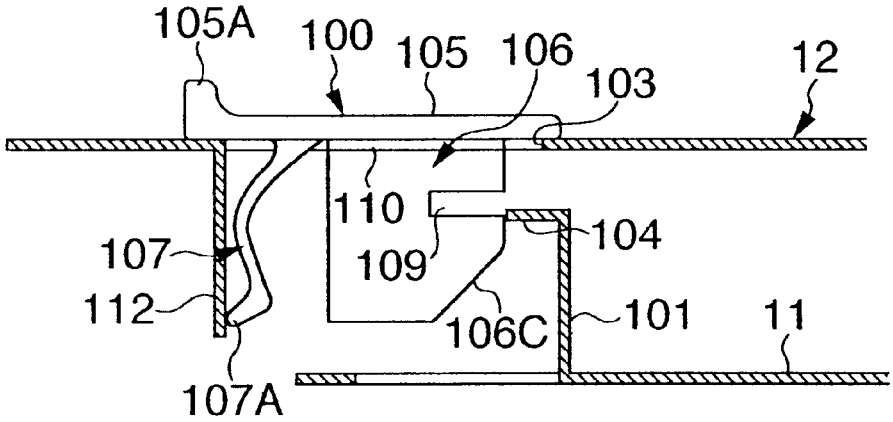
FIG. 53 is a schematic sectional view showing a state immediately before locking of the operating member.
Figure 54:
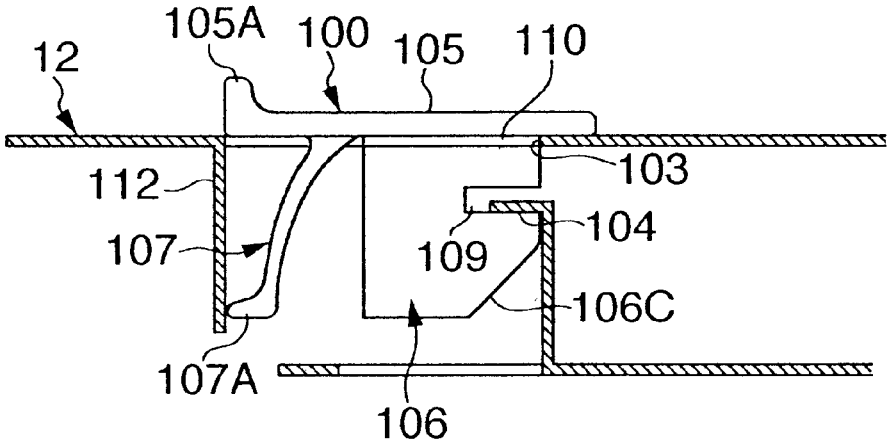
FIG. 54 is a schematic sectional view showing a locked state of the operating member.
Figure 55:
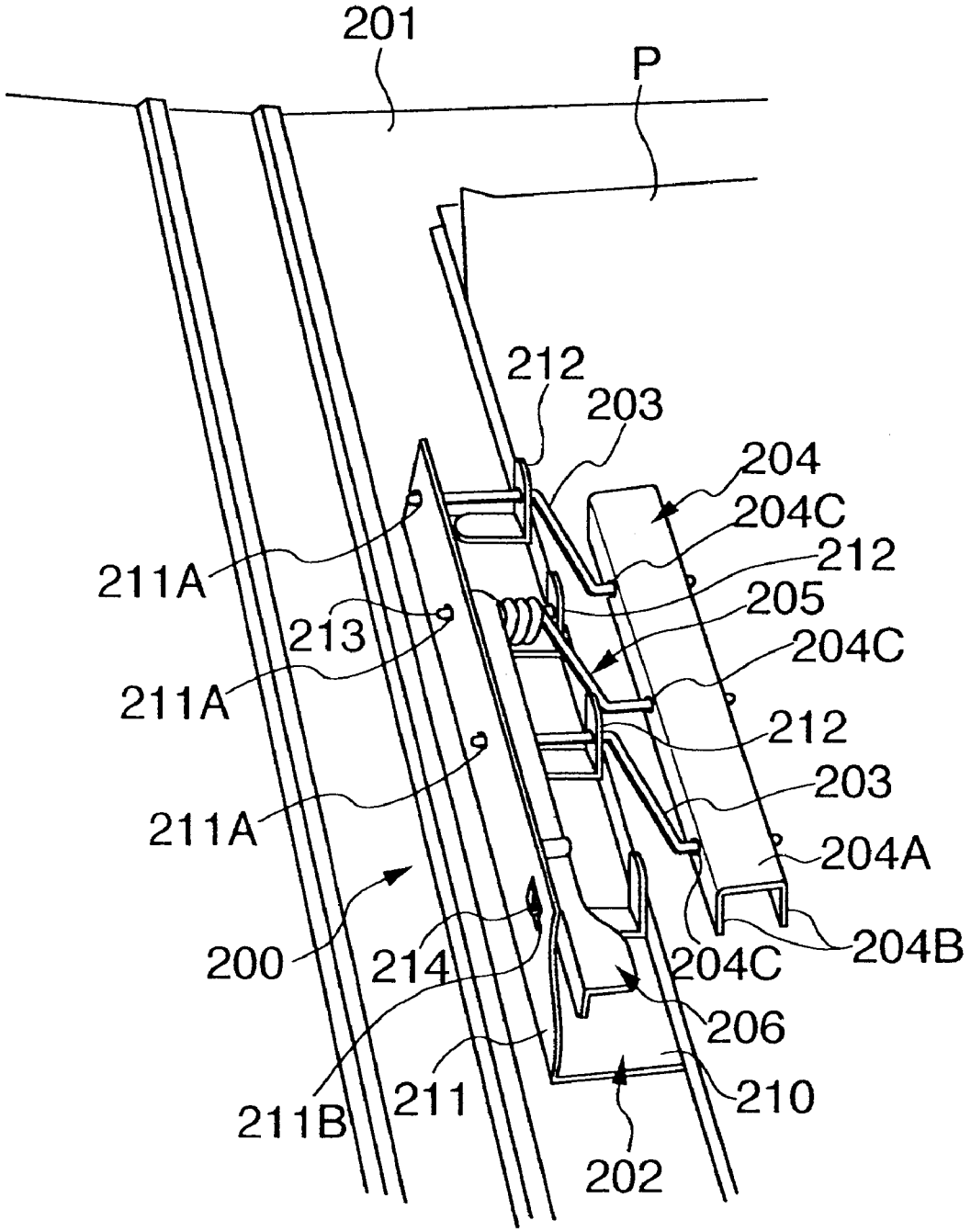
FIG. 55 is a schematic perspective view showing a conventional binder.

In this structure, to lock the operating member 12, as shown in FIG. 51, it is enough to apply a push-down force F by touching a fingertip to the free end side of the operating member 12. When the operating member 12 is rotated and displaced so as to be gradually directed in the horizontal direction, the pawl portion 104 contacts with the slope edge 106C of the piece member 106. When push-down force is further applied, the piece member 106 is pushed to the free end side of the operating member 12 by the pawl portion 104. As a result, the arm spring 107 curves and deforms, and the slide plate 105 slides to the free end side on the operating member 12.

When the pawl portion 104 passes through the operating member 106C and reaches the position of the notch 109, the curved and deformed arm spring 107 produces a return force as it attempts to return to its original shape. At this time the pawl portion 104 hooks onto the notch 109 with a snapping sound, hence the operating member 12 is maintained in a locked state.

When unlocking, on the other hand, a fingertip is touched to the upper side of the slide plate 105, which is pulled to the free end side of the operating member 12. As a result, when the slide plate 105 slides to the free end side on the operating member 12, the pawl portion 104 slips out of from the notch 109. When this happens, by the spring force of the spring member 16 positioned at the lower side of the operating member 12, the operating member 12 rotates so that its free end side may be positioned upward, and locking is released.

Therefore, the sixth embodiment also brings about the same advantages as the foregoing embodiments.

In the first to the third embodiments of the invention, as long as the operating member 12 can be locked or unlocked by applying an operating force in only one direction, the component parts may be changed freely. Also in the fourth to fifth embodiments of the invention, as long as the standing member 89 and operating member 12 can engage with each other, the shape and relative positions can be changed freely.

As described herein, the invention provides a binder which can be operated with a sense of extreme ease by locking or unlocking without changing the direction of force applied to the operating member, or the rotational trajectory of the operating member. In particular, in a configuration of an operating member provided with first and second operating spots so as to be capable of unlocking the second operating spot in the same manner as the operating direction of the first operating spot, locking can be released simply by operating the second operating spot. That is, unlike the related art, it is not necessary to apply pressing force to the operating member and moving force in the horizontal direction at the same time. Therefore the operating force to the operating member can be applied securely. It also eliminates deformation from torsion in the operating member.

Moreover, a slit is formed in the operating member to divide into first and second operating spots so that the structure of the operating member may be very simple.

Further, when the operating member is composed by assembling a separate part for composing the second operating spot in a main body having the first operating spot, for example, a piece member movable in the unlocking direction held so as not to fall off in the main body, the operating forces applied to the first and second operating spots are completely independent, thus enhancing the accuracy of the operation.

The second operating spot has a contact member contacting with a part of an extended shaft portion for composing the locking means, and is designed to displace the extended shaft portion in the unlocking direction with displacement of the position of this contact member. Therefore, by the operation of the second operating spot, the extended shaft portion can securely displace the axial position, and the locking state can be released securely. Deforming factors such as torsion on the operating member can be effectively absorbed by the extended shaft portion, thus enhancing the entire durability of the binder.

Further, a guide portion for keeping the trajectory of displacement of the extended shaft portion constant is provided in the operating member, and a stable displacement of the extended shaft portion is maintained so that malfunction can be prevented.

The locking means is composed of the first lock forming portion provided in the operating member, and the second lock forming portion to be hooked on the first lock forming portion provided at the base side. Locking of the operating member is released by displacing the first lock forming portion or second lock forming portion from the hooking position. Therefore, in such a configuration, simply by applying an external force from a fingertip to either lock forming portion, hooking of the lock forming portion can be released, simplifying the locking and unlocking operations.

In another configuration in which the first lock forming portion is formed of a hole provided in the operating portion and the second lock forming portion is formed of a standing member inserted in the hole to be hooked on the forming edge of the hole, the binding position of the operating member can be locked simply by moving the operating member to the binding position.

Also, in the configuration in which the first lock forming portion is formed of an outer edge of the operating member and the second lock forming portion is formed of a standing member to be hooked on the outer edge, the locking means can be composed without forming a hole in the operating member, thus simplifying the structure of the operating member.

When the tip of the standing member is formed to project from the upper side of the operating member at the binding position, the force for displacing the standing member can easily be applied to the standing member. Further, by keeping a specified height or length of the standing member, the standing member can be displaced easily and smoothly so that locking can be released without requiring excessive force.

Further, when the first lock forming portion is formed of a slide member, hooking on the second lock forming portion can be released smoothly.

In the configuration designed to unlock simply by operating the first lock forming portion in the extending direction of the operating member, operating force can be easily applied to the first lock forming portion.

What is claimed is:

1. A binder, comprising:

a base;

an operating member having a first end supported on the base and a second end movable relative to the base;

a pressing member coupled to and driven by the operating member, said pressing member being movable toward and away from the base by movement of the operating member;

a spring member connecting the base and the operating member; and first and second locking elements cooperating with each other in a locking position for locking the operating member when the pressing member is set in a binding position relative to the base;

wherein the operating member has first and second operating spots, and the operating member is locked and the pressing member is held in the binding position when the first operating spot is operated in a specified direction, while locking of the operating member is released, enabling the pressing member to move from the binding position, when the second operating spot is operated in the specified direction; and wherein the first and second operating spots are divided by a slit formed in the operating member.

2. A binder, comprising:

a base;

an operating member having a first end supported on the base and a second end movable relative to the base;

a pressing member coupled to and driven by the operating member, said pressing member being movable toward and away from the base by movement of the operating member;

a spring member connecting the base and the operating member; and first and second locking elements cooperating with each other in a locking position for locking the operating member when the pressing member is set in a binding position relative to the base;

wherein the operating member has first and second operating spots, and the operating member is locked and the pressing member is held in the binding position when the first operating spot is operated in a specified direction, while locking of the operating member is released, enabling the pressing member to move from the binding position, when the second operating spot is operated in the specified direction; and wherein the operating member comprises a main body having the first operating spot and a separate part that forms the second operating spot.

3. The binder according to claim 2, wherein the separate part is made of a piece member retained by the main body, and the piece member is movable in the specified direction without falling off the main body.

4. A binder, comprising:

a base;

an operating member having a first end supported on the base and a second end movable relative to the base;

a pressing member coupled to and driven by the operating member, said pressing member being movable toward and away from the base by movement of the operating member;

a spring member connecting the base and the operating member; and first and second locking elements cooperating with each other in a locking position for locking the operating member when the pressing member is set in a binding position relative to the base;

wherein the operating member has first and second operating spots, and the operating member is locked and the pressing member is held in the binding position when the first operating spot is operated in a specified direction, while locking of the operating member is released, enabling the pressing member to move from the binding position, when the second operating spot is operated in the specified direction;

the first locking element comprises an extended shaft portion extending to the spring member and extending to the first and second operating spots;

the second locking element comprises a hook portion provided in the base for catching the extended shaft portion; and when the first operating spot is pressed in the specified direction, the extended shaft portion is moved to the locking position to be caught by the hook portion so as to lock the operating member, and when the second operating spot is pressed in the specified direction, the extended shaft portion is displaced from the locking position so as to release the locking of the operating member.

5. The binder according to claim 4, wherein the second operating spot comprises a contact member contacting with the extended shaft portion, and the extended shaft portion is displaced in an unlocking direction with displacement of the contact member when the second operating spot is pressed.

6. The binder according to claim 4, wherein the operating member comprises a guide portion for keeping a trajectory of displacement of the extended shaft portion constant.

7. A binder, comprising:

a base;

an operating member having, in a longitudinal direction thereof, a first end supported on the base and a second end movable relative to the base;

a pressing member coupled to and driven by the operating member, said pressing member being movable selectively toward and away from the base by movement of the operating member;

a spring member connecting the base and the operating member; and first and second locking elements cooperating with each other for locking the operating member in a locking position with the pressing member being accordingly set in a binding position relative to the base;

wherein the first locking element is provided in the operating member, and the second locking element is provided on the base, and locking of the operating member is released by displacing one of the first locking element and the second locking element from a locked condition;

the second locking element comprises a standing member having a close end portion connected to the base and an opposite, distal end portion which is flexible; and the first locking element is a hole provided in the operating member, and the distal end portion of the standing member is sized and shaped to be insertable into the hole and engage with an edge of the hole in the locked condition.

8. The binder according to claim 7, wherein the standing member has a projection and an inner wall of the hole has a groove for receiving and retaining the projection in the locked condition.

9. A binder, comprising:

a base;

an operating member having a first end supported on the base and a second end movable relative to the base;

a pressing member coupled to and driven by the operating member, said pressing member being movable toward and away from the base by movement of the operating member;

a spring member connecting the base and the operating member; and first and second locking elements cooperating with each other in a locking position for locking the operating member when the pressing member is set in a binding position relative to the base;

wherein the operating member has first and second operating spots, and the operating member is locked and the pressing member is held in the binding position when the first operating spot is operated in a specified direction, while locking of the operating member is released, enabling the pressing member to move from the binding position, when the second operating spot is operated in the specified direction; and wherein the first locking element is attached to the operating member and the second locking element is formed on the base, the first locking element having at least one portion that is movable with respect to the operating member.

10. The binder according to claim 9, further comprising a guiding member for guiding the first locking element along a predetermined path into and out of the locking position.

* * * * *